US007637503B2

(12) United States Patent
Sorge

(10) Patent No.: US 7,637,503 B2
(45) Date of Patent: Dec. 29, 2009

(54) ROULETTE GAME APPARATUS WITH SIDE BET GAME

(76) Inventor: Nicholas Sorge, 7 Susan Ct., Deer Park, NY (US) 11729-2715

( * ) Notice: Subject to any disclaimer, the term of this patent is extended or adjusted under 35 U.S.C. 154(b) by 262 days.

(21) Appl. No.: 11/787,473

(22) Filed: Apr. 17, 2007

(65) Prior Publication Data

US 2008/0258383 A1 Oct. 23, 2008

(51) Int. Cl.
*A63F 5/02* (2006.01)

(52) U.S. Cl. ..... 273/274; 273/142 E; 463/17

(58) Field of Classification Search ..... 273/274, 273/142 E, 142 F, 142 G, 142 H, 142 HA; 463/17; D21/375
See application file for complete search history.

(56) References Cited

U.S. PATENT DOCUMENTS

| | | | | |
|---|---|---|---|---|
| D92,059 | S | 4/1934 | Anderson | |
| D106,967 | S | 11/1937 | Danon | |
| 4,077,631 | A | 3/1978 | Tela, Sr. | |
| 5,141,234 | A | 8/1992 | Boylan et al. | |
| 5,540,442 | A * | 7/1996 | Orselli et al. | 463/17 |
| 5,636,838 | A | 6/1997 | Caro | |
| 6,227,542 | B1 * | 5/2001 | Cosmi | 273/142 E |
| 6,352,260 | B1 | 3/2002 | Santiago | |
| 6,406,021 | B1 | 6/2002 | Nadibaidze | |
| 6,406,022 | B1 | 6/2002 | Nadibaidze | |
| 2002/0010014 | A1 * | 1/2002 | Parra et al. | 463/17 |
| 2003/0094752 | A1 | 5/2003 | Mathews | |
| 2005/0192076 | A1 | 9/2005 | Lowery | |
| 2005/0192079 | A1 | 9/2005 | Lowery | |
| 2006/0009274 | A1 | 1/2006 | Finocchio | |
| 2006/0249899 | A1 | 11/2006 | Lease | |

OTHER PUBLICATIONS

U.S. Appl. No. 11/725,073.
U.S. Appl. No. 11/593,322.
U.S. Appl. No. 11/389,197.
Ion Saliu, "Roulete Number Pairing Analysis". *Gambling analysis datasheet*. (2007).

* cited by examiner

*Primary Examiner*—Benjamin H Layno
(74) *Attorney, Agent, or Firm*—Scully, Scott, Murphy & Presser, P.C.

(57) ABSTRACT

A roulette game including a board game surface and roulette wheel, wherein besides the traditional roulette wheel wagering opportunities, an additional novel wagering area is provided for additional "side betting." That is, a side wagering area comprising ten individual wagering areas corresponding to a digit value 0, . . . , 9, is provided for the game board surface. A bettor may conduct a wager by placing a chip or marker on a particular digit value of the side wagering area for indicating a wager that a resulting digit of a one digit or two digit whole number roulette spin outcome will match that digit value being wagered. The payout odds for a winning side bet adheres to house advantages established for both American and European style roulette games.

28 Claims, 18 Drawing Sheets

ROULETTE GAME APPARATUS WITH SIDE BET GAME

BACKGROUND OF THE INVENTION

1. Field of the Invention

The invention relates to apparatuses for playing Roulette and an improved Roulette game surface for conducting additional wagers in a Roulette wheel game.

2. Description of the Prior Art

Roulette is a well-known game of chance enjoyed throughout the world. The equipment used for playing roulette generally comprises a roulette wheel and a game surface.

The roulette wheel generally comprises a horizontally disposed wheel mounted in a bowl-shaped housing. The wheel is adapted to rotate about a vertical axis and includes a plurality of pockets disposed around its periphery. Each pocket has a unique number associated with the pocket, as well as a color associated therewith. Each pocket is adapted to receive a small ball, which is introduced into the bowl-shaped housing by an operator or croupier as the wheel is set in motion. The wheel is typically spun in one direction and the ball projected around the circumference of the housing in an opposite direction. As the ball loses speed, it rolls down the concave housing wall, eventually coming to rest in one of the pockets. The outcome or result of the spin is the number and color associated with the pocket in which the ball comes to rest.

The game surface includes a plurality of wagering areas indicating various numbers, colors, parities (the odd or even quality of a number) and groupings of numbers. One or more players make wagers on a predicted outcome of a spin of the roulette wheel. A players indicates his or her wager by placing one or more wagering devices, such as chips or markers representing an amount of the wager, at a predetermined location on the game surface corresponding to a predicted outcome of a spin of the roulette wheel. There are several types of wagers possible in the traditional Roulette game. For example, one may place a wager on a single number, or two numbers (by placing your chip so it straddles the line on the game board surface between any two numbers). There are red, black, odd and even bets, and, a "dozens" bet made on the 12 consecutive numbers where wagers are placed in boxes marked 1-12, 13-24 or 25-36, for example, for a 36 number roulette game.

In attempts to enhance the betting opportunities of the traditional Roulette game including a board game surface and roulette wheel, besides providing the ability to place traditional wagers, e.g., wager on a particular number by placing one or more chips or markers within the wagering area(s) corresponding to that number, or, wager on groupings of individual numbers, additional novel wagering areas have been proposed for additional "side betting."

For example, U.S. Pat. No. 5,540,442 describes a modified roulette game offering an additional betting opportunity. When a winning bet in the conventional layout is determined by the operation of the roulette wheel, a random number generator also generates and displays one of the conventional roulette numbers, i.e, 1-36, 0 or 00. If the number displayed by the random number generator is the same as the winning number that is determined by the roulette wheel spin outcome, the side bet on that number is an additional winning bet.

This prior art Roulette game requires use of an additional random number generator, which may certainly add to the cost and complexity of the game.

It would thus be highly desirable to provide an enhanced Roulette game having a game board surface that provides for additional side-betting opportunity besides the traditional Roulette wagering in a simple and manner.

SUMMARY OF THE INVENTION

The present invention is directed to a Roulette game having a Roulette wheel and game board surface for enabling wagers on Roulette wheel spin outcomes, and that further includes an additional side wagering area comprising at least ten additional wagering areas corresponding to a digit value 0,9, wherein a bettor conducts a wager by placing a marker, chip or similar marking means on a particular digit value of said side wagering area for indicating a wager that a resulting digit of the one or two digit whole number Roulette wheel spin outcome will additionally match that digit value being wagered in the side wagering area.

It is understood that the at least ten wagering areas corresponding to a digit values 0, . . . , 9, each have an associated wager odds determined for these numbers. The wager payout odds corresponding to the at least ten wagering areas adhere to the house advantage established for American and European style roulette wheel games.

In an alternate embodiment, special treatment is given and an additional wager area is provided with separate payout odds calculated for Roulette wheel number outcomes having two similar digits, i.e., 11, 22 and 33 due to their uniquely having two of the same whole numbers in the 36 number board.

Thus, according to one aspect of the invention, there is provided in a roulette game apparatus having a roulette wheel comprising a plurality of indicia arranged in a circumferential manner about the wheel, each of the indicia associated with a unique number and a color, and further comprising means for operating the wheel for generating an outcome or result comprising a one digit or two digit number and associated color, and, a roulette game surface having one or more wagering areas for placing wagers on an outcome or result of a roulette wheel operation, wherein the wagering areas for placing wagers includes one or more house number wagering areas, wagering areas for each individual single digit or two-digit number outcomes, wagering areas for placing wagers on groups of numbers, wagering areas for wagering on odd number or even number outcomes, and, wagering areas for wagering on a color outcome, an improvement comprising:

An additional wagering area for said game surface comprising ten individual wagering areas corresponding to a digit value 0, . . . , 9, wherein a bettor conducts a wager by placing a marker means on a particular digit value of said side wagering area for indicating a wager that a resulting digit of said one digit or two digit whole number outcomes will match that digit value being wagered.

The additional side betting scheme for a Roulette game may be implemented in both traditional American style wheel having 38 numbers (0-36 number plus two additional "house" numbers 0, 00) and European style Roulette wheels having 37 numbers (0-36 plus one "house" number), and further, may be incorporated in many new emerging Roulette style games in the United States and throughout the world. For example, the present invention may be implemented in more balanced arrangements Advantageously, the addition of side-betting renders the roulette game more exciting as more additional players may be attracted to the additional wager scheme provided by the invention.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements.

DETAILED DESCRIPTION OF THE PREFERRED EMBODIMENTS

Figure 1:
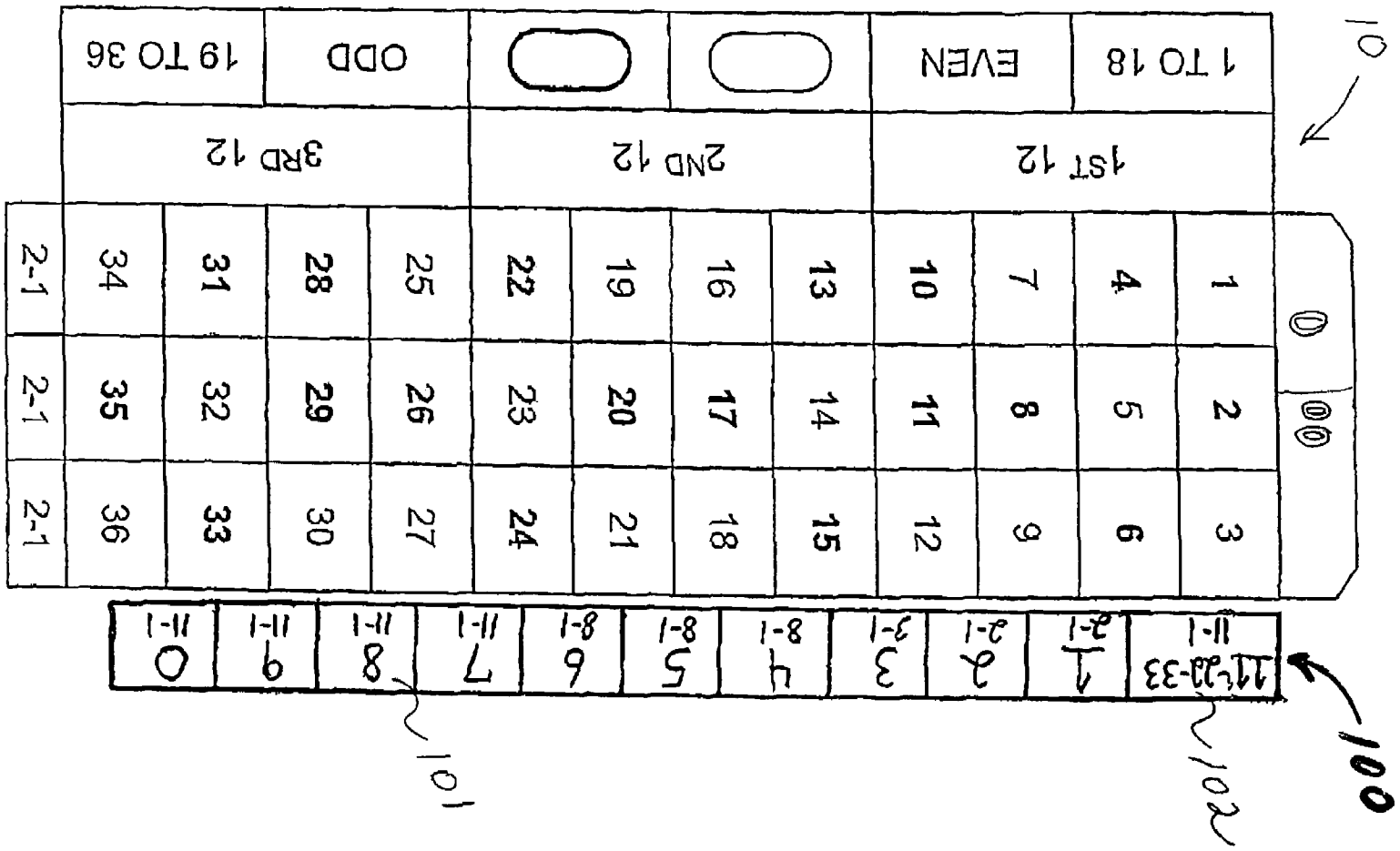
FIG. 1 shows a conventional game surface 10 for a roulette game in combination with the additional side-betting area 100 of the invention.

In the drawings, numbers and symbols in regular typeface indicate a first color, for example red. Numbers and symbols in bold typeface indicate a second color, for example black. Numbers in an outline type format indicate a third color or fourth color, for example green or gold, respectively.

Figure 5:
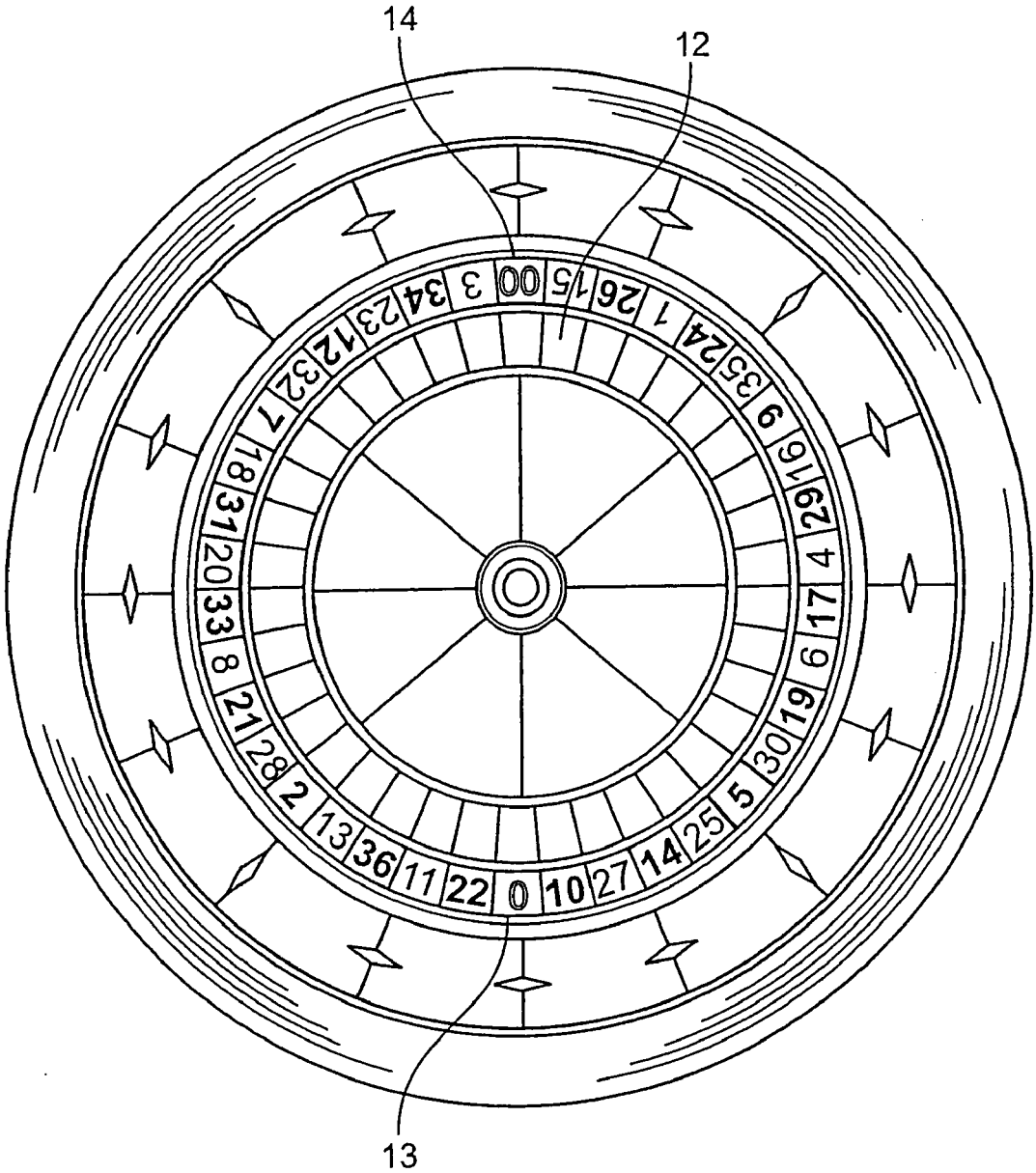
FIG. 5 shows an American roulette wheel arrangement for use with the game surface 10' shown in FIG. 4, according to an embodiment of the invention.

In accordance with the invention, as shown in FIG. 1, a side-bet wagering area 100 is provided with a Roulette game board surface 10 that facilitates additional user wagering activity. That is, the side bet wagering area 100 provides a unique arrangement of individual wagering numbers comprising whole numbers from 0, . . . , 9 that are typically gold in color. Each individual wagering number of the additional novel wagering area 100 provide users with an additional wager opportunity or "side-bet". In addition to traditional roulette bets, a user side bet is indicated when a user has placed a chip(s) or marker(s) on a particular whole number or numbers. At the outcome of each roulette wheel spin, the user side bet numbers of the additional wager area 100 are compared with the one or two digit number outcome of each roulette wheel spin. If any one digit of the resulting one or two digit number or outcome of the roulette wheel spin match the side-bet whole number, then this is winning bet and the house pays out according to a specified odds. For example, in the embodiment of a 36 number roulette wheel and corresponding game board surface such as shown in FIG. 1, a user placing a chip or marker on the number "8"(101) of the additional novel wagering area 100 will win the "side bet" against the house having a payout of 11-1, if the outcome of the 36 number roulette wheel spin is either an 8, 18, or 28. Note that each of the individual wagering number of the additional novel wagering area 100 has a corresponding payout that substantially conforms to the "house" advantage. For purposes of illustration, these odds may be roughly calculated in one manner as a ratio comprising: the total number of ways to lose the bet/the total number of possible digit matching Roulette wheel spin outcomes. For the example side-bet wager placed on the number "8" box 101 of the additional novel wagering area 100: for a 36 number roulette wheel having two house numbers, 0, 00 making a total of 38 possible outcomes, there are three (3) possible winning roulette wheel outcomes: 8, 18 and 28: thus, the total possible number of ways to win is 3; and the total number of ways to lose is 38-(3) is 35. Thus, accounting for the house advantage, the ratio is 35/3 or roughly 11.66:1. In an embodiment, the ratio may be rounded up, such as in this instance to 12:1, and in another embodiment, the ratio may be rounded down to 11:1, as indicated in FIG. 5.

In the embodiment depicted in FIG. 1, a separate individual wagering area 102 is provided for the whole digit numbers 11, 22 and 33 due to their uniquely having two same whole number digits in the 36 number board. That is, for a 36 number roulette wheel game board surface 10 depicted in FIG. 1, the additional wagering area 100 provides an additional wagering box 102 comprising whole numbers 11, 22 and 33 having a corresponding wager payout odds, e.g., 11-1. As there are only 3 possible roulette wheel spin outcomes resulting in the numbers 11, 22 and 33, the payout odds are calculated as in the example given hereinabove. Thus, a user placing a chip or marker on this additional wager box 102 of the additional novel wagering area 100 will win the "side bet" if the outcome of the roulette wheel spin is either an 11, 22 or 33. Again, as in the example provided hereinabove, the wager payout odds corresponding to this wagering area 102 conforms with the house advantage for American and European style roulette wheel games.

In the further embodiment of the present invention including further waging area 102 in the game board surface comprising additional wagering area 100 as depicted in FIG. 1, a bettor placing a chip or marker on number 3 of the additional game board surface 100 will win if the outcome of the roulette wheel spin is either a 3, 13, 23, 30, 31, 32, 34, 35, 36. For a 36 number roulette wheel having two house numbers, 0, 00 making a total of 38 possible outcomes, there are thus nine (9) possible winning roulette wheel outcomes: thus, the total possible number of ways to win is 9; and the total number of ways to lose is 38-(9) is 29. Thus, accounting for the house advantage, the ratio is 29/9 or 3:1. Note that in this alternate embodiment, a resulting roulette spin outcome of the number 33 would not result in a win for the bettor who has placed a chip or marker on the number "3" box of the additional wagering area 100 as the numbers 33 has been taken out and placed in the separate wager area 101.

A conventional roulette game surface or board for use in combination with the additional side wagering area comprising at least ten additional wagering areas according to the present invention is shown in FIG. 1. As shown in FIG. 1, the conventional game surface 10 includes wagering areas corresponding to the individual numbers 1 through 36. The numbers are arranged sequentially in three columns of twelve numbers each and twelve rows or streets of three numbers each. In the example embodiment depicted, eighteen of the numbers (1, 3, 5, 7, 9, 12, 14, 16, 18, 19, 21, 23, 25, 27, 30, 32, 34 and 36) correspond to a first color, typically red, and the remaining eighteen numbers (2, 4, 6, 8, 10, 11, 13, 15, 17, 20, 22, 24, 26, 28, 29, 31, 33 and 35) correspond to a second color, typically black. In this arrangement, there are eight even red numbers (12, 14, 16, 18, 30, 32, 34 and 36), ten odd red numbers (1, 3, 5, 7, 9, 19, 21, 23, 25, and 27), ten even black numbers (2, 4, 6, 8, 10, 20, 22, 24, 26 and 28) and eight odd black numbers (11, 13, 15, 17, 29, 31, 33 and 35)

A player may place a wager on a particular number by placing one or more chips or markers within the wagering area corresponding to that number. In addition, players can wager on groupings of individual numbers. For example, a player can wager on a column of numbers by placing one or more chips or markers adjacent to the column of numbers, on a row of numbers by placing one or more chips or markers adjacent to the row of numbers, on two rows of numbers by placing one or more chips or markers adjacent to the two rows of numbers, and on four adjoining numbers by placing one or more chips or markers at the intersection of the four adjoining numbers.

As shown in FIG. 1, wagering areas are also typically provided for betting on the number 0 (and/or the number 00 in an American style wheel), on a particular color outcome (for example red or black), on an even or odd number outcome, on an outcome comprising a number from 1 to 18, on an outcome comprising a number from 19 to 36 and on a particular set or block of numbers (for example first twelve number 1 through 12, second twelve numbers 13 through 24 or last twelve numbers 25 through 36).

Winning wagers in the game of roulette are paid out at predetermined multiples based on the probability of the particular predicted outcome. For example, a winning wager for an individual number may pay out at a ratio of 35 to 1; a winning wager for a row of three numbers may pay out at a ratio of 11 to 1; a winning wager for a group of four adjacent numbers may pay out at a ratio of 8 to 1; a winning wager for two adjacent rows of number may pay out at a ratio of 5 to 1; a winning wager for the combination of numbers 1 to 18 or the combination of numbers from 19 to 36 may pay out at a ratio of 1 to 1; a winning wager on a column of numbers may pay out at a ratio of 2 to 1; a winning wager on a block of twelve consecutive numbers (first twelve, second twelve or last twelve) may pay out at a ratio of 2 to 1, and a winning wager on an odd number; an even number, a red number or a black number may pay out even money.

In another embodiment, in a variation thereof, if the roulette wheel had only one house number "0" instead of the "0" and "00" depicted in FIG. 1 the side bet numbers of the additional Wager area 100 will be the same as that depicted in FIG. 1 with the same odds depicted. It is also to be noted that no matter how the whole numbers are arranged on the roulette wheel and the roulette wheel game board surface, if there are one or two house numbers (0, 00) on the roulette wheel containing 36 whole numbers, in an embodiment, the side wagering area will be depicted as shown in FIG. 1, and the odds are as depicted therein.

Figure 2:
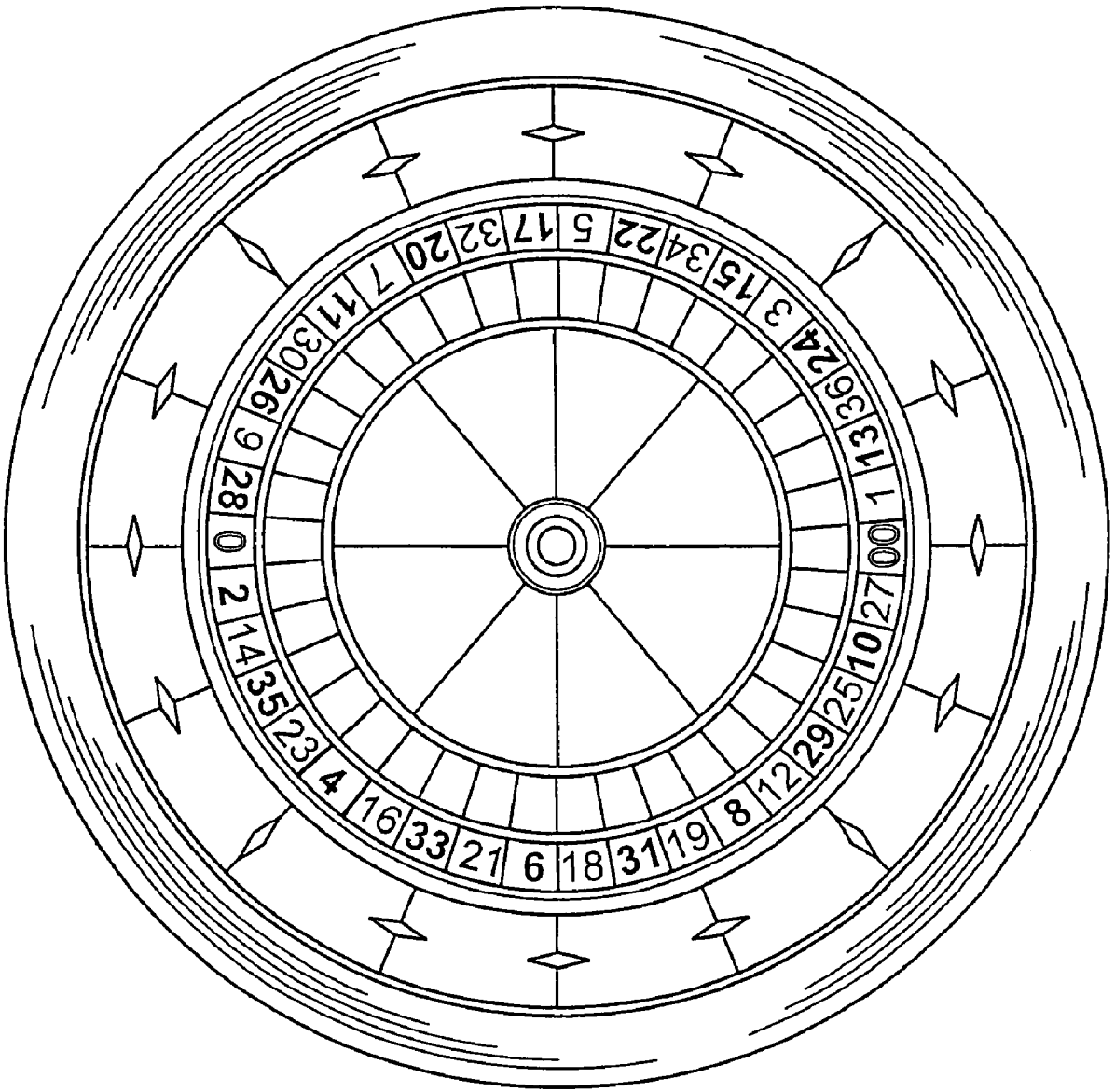
FIG. 2 shows a conventional American wheel arrangement for use with the game surface shown in FIG. 1.

FIG. 2 depicts a roulette wheel arrangement that may be used in combination with the roulette wheel game board surface shown in FIG. 1 including side-wagering area 100 of the present invention. The roulette wheel shown in FIG. 2, is a roulette wheel having an example arrangement of indicia according to the American roulette wheel arrangement, the indicia including numbers from 1 to 36 arranged at standardized positions around the perimeter of the wheel with black and red numbers alternating, and directly across the wheel from each odd number is the next highest even number (for example the number 10 is directly across the wheel from the number 9). In this American roulette wheel arrangement, both zero (0) and double zero (00) house numbers arranged opposite each other arranged around the perimeter of the wheel for a total of thirty-eight pockets. The house numbers (0, 00) are typically green in color. In one embodiment, the numbers 1, 3, 5, 7, 9, 12, 14, 16, 18, 19, 21, 23, 25, 27, 30, 32, 34 and 36 are red, and the numbers 2, 4, 6, 8, 10, 11, 13, 15, 17, 20, 22, 24, 26, 28, 29, 31, 33 and 35 are black. However, the roulette wheel and corresponding game board surface including the side wagering area 100 of the invention is not so limited, and many different variations of the wheel and game board surface configurations are contemplated.

Figure 3:
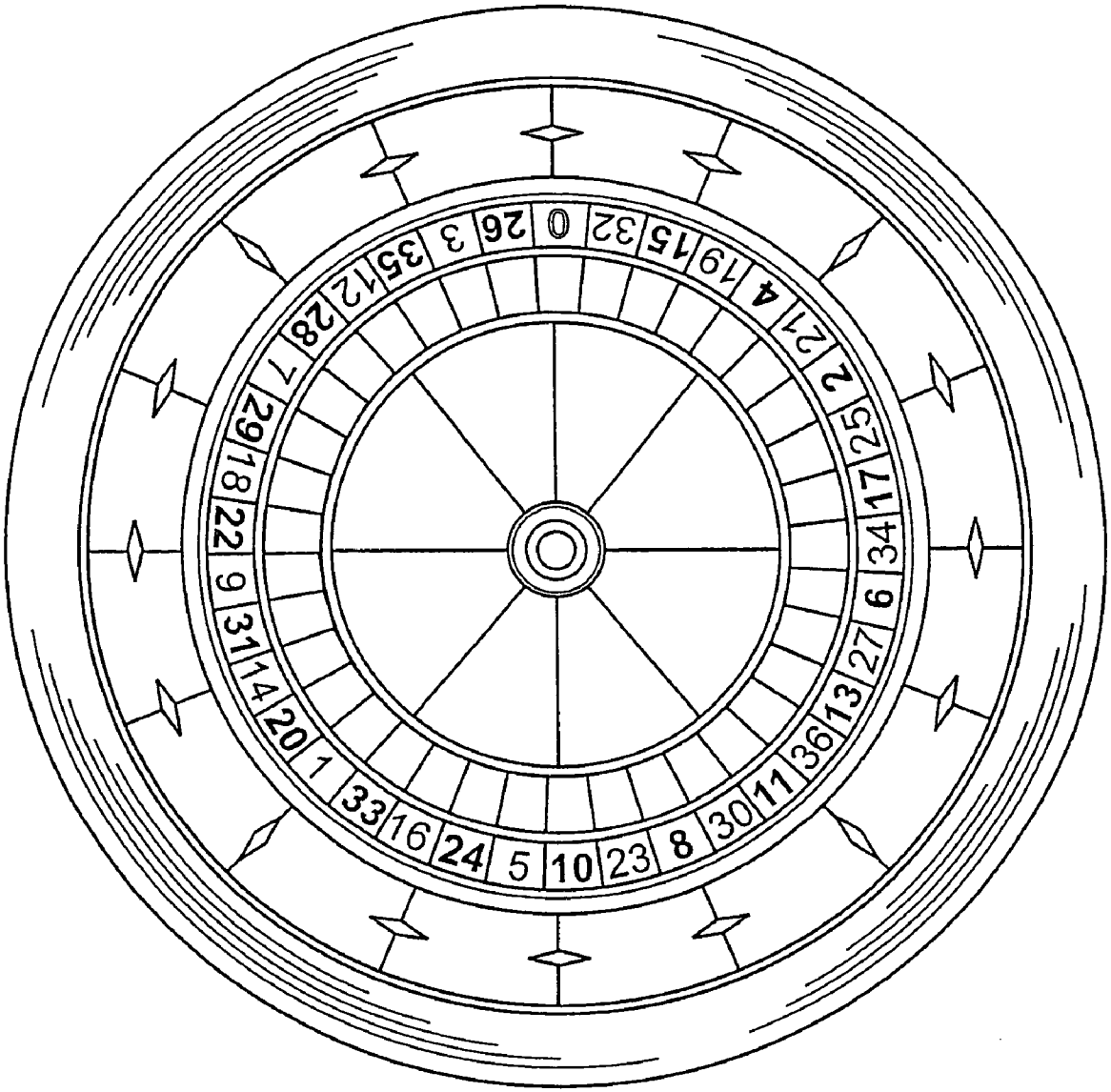
FIG. 3 shows a conventional European wheel arrangement for use with the game surface shown in FIG. 1.

FIG. 3 shows the prior art European roulette wheel arrangement that may be used in combination with the roulette wheel game board surface including the additional wagering area 100 of the present invention. As shown, the European roulette wheel arrangement includes only one house number, the single zero (0) and thirty-six numbers, for a total of thirty-seven pockets. This results in a significantly lower house advantage for the European wheel (approximately 2.70%) as compared to the American wheel (approximately 5.26%). The individual numbers from 1 to 36 in the prior art European roulette wheel have the same colors as they have in the prior art American roulette wheel, and the numbers are also arranged at standardized positions; however the arrangement of numbers around the wheel differs substantially in the European roulette wheel as compared to the American wheel.

As described in applicant's co-pending U.S. patent application Ser. No. 11/389, 197 entitled ROULETTE GAME APPARATUS AND METHOD, the entire contents and disclosure of which is incorporated by reference herein, the arrangement of numbers and colors on the roulette game surface shown in FIG. 1 (and used with both the standard American roulette wheel arrangement shown in FIG. 2 and the European roulette wheel arrangement shown in FIG. 3, is not optimized or balanced with respect to the entire game surface, the individual columns and the individual dozen wagering groups (1-12, 13-24 and 25-36) as set forth below. In particular, the distribution of red, black, odd and even numbers on the prior art roulette game surface is unbalanced and as a result experienced players may combine bets on red, black, even and odd numbers, columns and dozen groups to increase the player's chances of winning a bet. In addition, an inexperienced player may lack the knowledge to take advantage of these relationships, resulting in a greater advantage for the casino or house.

One example of this imbalance is demonstrated in the roulette game surface arrangement 10 shown in FIG. 1 that has ten red odd numbers (1, 3, 5, 7, 9, 19, 21, 23, 25 and 27), but only eight red even numbers (12, 14, 16, 18, 30, 32, 34 and 36). Additionally, the arrangement has ten black even numbers (2, 4, 6, 8, 10, 20, 22, 24, 26, 28), but only eight black odd numbers (11, 13, 15, 17, 29, 31, 33 and 35). This imbalance in the distribution of red, black, odd and even numbers throws off the balance of the individual columns and dozen wagering areas.

In a further example, a game board surface "column" type imbalance is demonstrated in the roulette game surface arrangement 10 of FIG. 1, wherein the first column consists of six red numbers (1, 7, 16, 19, 25 and 34). Of these six red numbers, however, four numbers are odd (1, 7, 19 and 25) and only two numbers are even (16 and 34). Moreover, two of the odd red numbers (1 and 7) are in the first dozen wagering area, whereas the second and third dozen wagering areas each have one red odd and one red even number in the first column (16, 19 and 25, 34, respectively) Thus, the first column includes one even red number (16) in the second dozen wagering area, one even red number (34) in the third dozen wagering area, but no even red numbers in the first dozen wagering area.

The first column in the roulette game surface of FIG. 1 further includes six black numbers (4, 10, 13, 22, 28, and 31). Of these six black numbers, however, four numbers are even (4, 10, 22, and 28) and only two numbers are odd (13 and 31). Moreover, two of the black even numbers (4 and 10) are in the first dozen wagering area, whereas the second and third dozen wagering areas each have one black odd and one black even number in the first column (13, 22 and 28, 31, respectively). Thus the first column includes one odd black number (13) in the second dozen wagering area, one odd black number (31) in the third dozen wagering area, but no odd black numbers in the first dozen wagering area. The same type imbalances are demonstrated in the second and third column wagering areas of the game board surface arrangement 10 of FIG. 1.

In a further example, a game board surface dozen wagering areas or groups type imbalance is demonstrated by the roulette game surface arrangement 10 of FIG. 1, wherein the first dozen wagering area (1-12) includes six red numbers (1, 3, 5, 7, 9 and 12) and six black numbers (2, 4, 6, 8, 10 and 11). However of the six red numbers, five are odd (1, 3, 5, 7 and 9) and only one is even (12). Moreover, of the six black numbers in the first dozen wagering area, five are even (2, 4, 6, 8 and 10) and only one is odd (11). Accordingly, the first dozen wagering area of the roulette game surface of FIG. 1 is unbalanced with respect to the distribution of red, black, odd and even numbers. The same type imbalances are demonstrated in the second and third dozen wagering areas of the game board surface arrangement 10 of FIG. 1.

In addition to the uneven distribution of red, black, odd and even numbers on the roulette game surface of FIG. 1, it has been observed that the arrangement of corresponding numbers on the prior art roulette wheels (both American and European) has a relationship to various arrangements of colors, odds, evens, columns and groups on the roulette game surface. That is, the relationships among adjacent numbers on the prior art roulette wheels and their corresponding positions, groupings and characteristics on the prior art roulette game surface may allow experienced players to combine bets on red, black, even and odd numbers, columns and dozen groups to increase the player's chances of winning. For example in the prior art arrangements, players may "flower" the wheel by placing bets corresponding to a group of numbers positioned on the roulette wheel adjacent or in close proximity to one another. By utilizing progressive betting techniques and taking advantage of the relationship between the positions of the numbers on the roulette wheel and the various betting schemes (red, black, odd, even, column, dozen group) a professional or experienced player may increase his or her odds of winning.

FIGS. 4, 9, 11 and 13A and 13B illustrate more balanced roulette game surfaces or boards including the further side-bet wagering areas of the present invention. FIGS. 5, 6, 7, 8, 10, 12 and 14 show more balanced roulette wheel arrangements corresponding with the roulette game surfaces or boards of FIGS. 4 9, 11 and 13A and 13B. In particular, FIGS. 5, 6, 7 and 8 show roulette wheel arrangements suitable for use with the game surface shown in FIG. 4. FIG. 10 shows a roulette wheel arrangement suitable for use with the game surface shown in FIG. 9; and, FIG. 12 shows a roulette wheel arrangement suitable for use with the game surface shown in FIG. 11. FIGS. 10 and 12 represent a more balanced type of Roulette wheel game as described in Applicant's co-pending U.S. patent application Ser. No. 11/593,322, the contents of which are incorporated by reference as if fully set forth herein. FIG. 14 shows a roulette wheel arrangement suitable for use with the game surface shown in FIG. 13A. FIG. 14 particularly represents a further balanced type of Roulette wheel game as described in Applicant's co-pending U.S. patent application Ser. No. 11/725,073 entitled SUPER ROULETTE WHEEL, incorporated by reference as if fully set forth herein.

Figure 6:
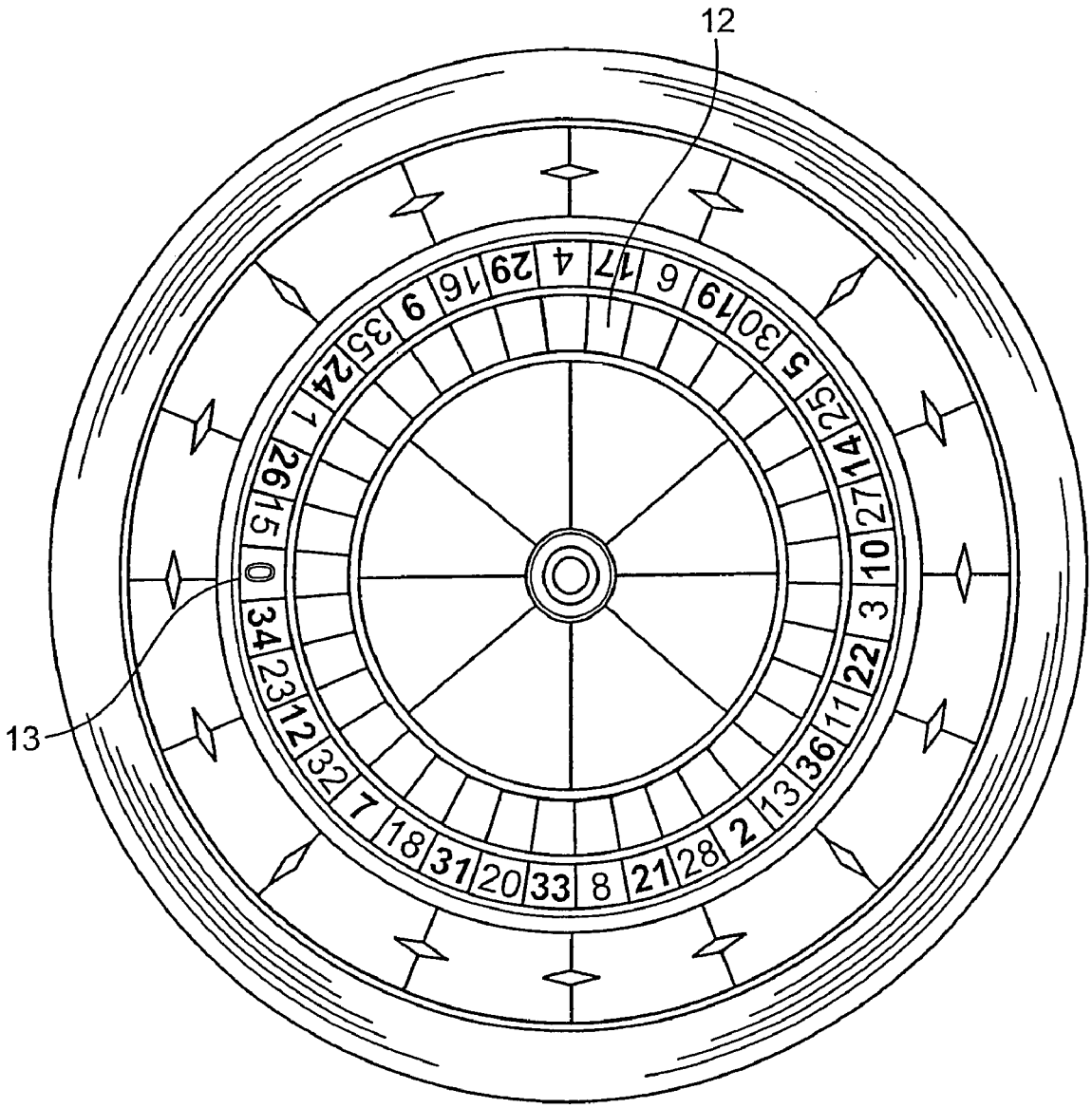
FIG. 6 shows a European roulette wheel arrangement for use with the game surface 10' shown in FIG. 4, according to an embodiment of the invention.
Figure 7:
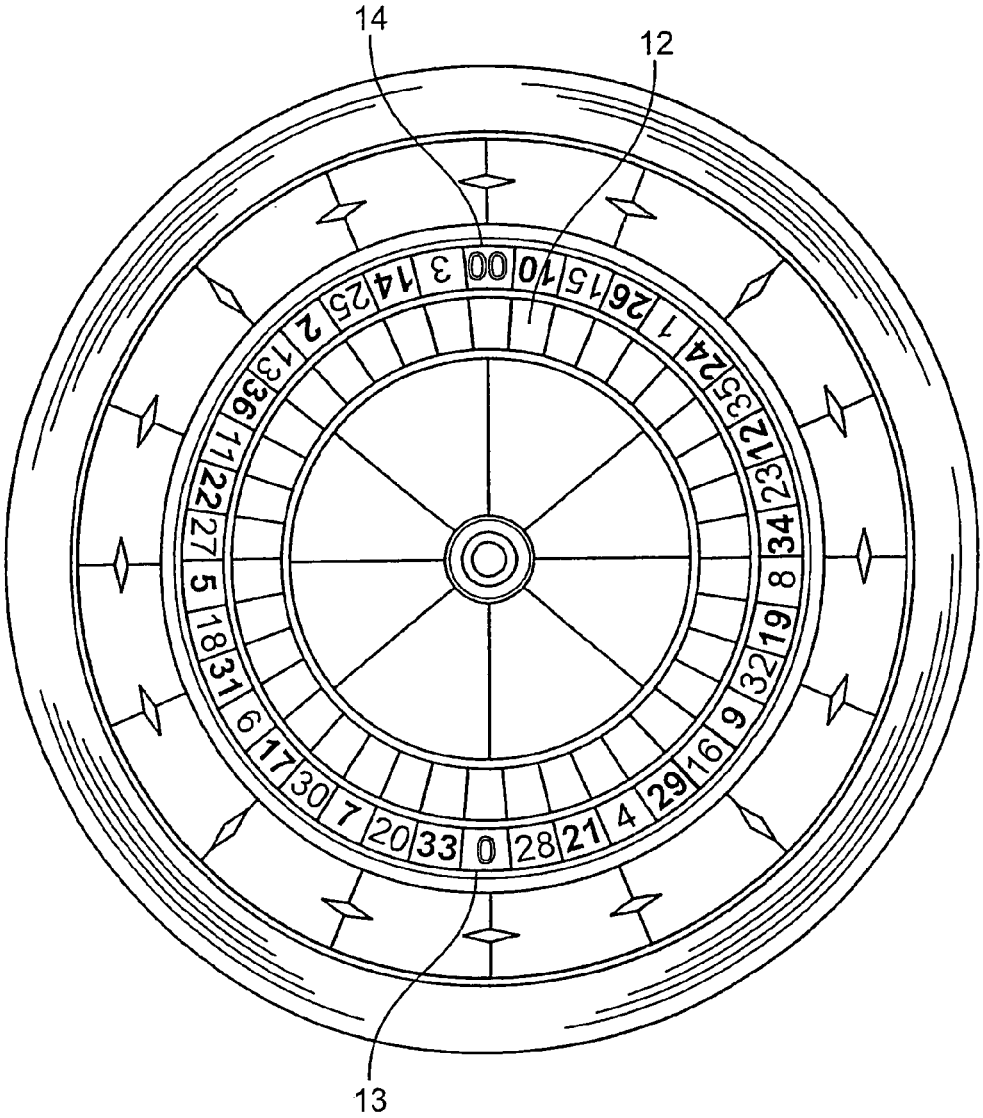
FIG. 7 shows another American roulette wheel arrangement for use with the game surface 10' shown in FIG. 4, according to an embodiment of the invention.
Figure 8:
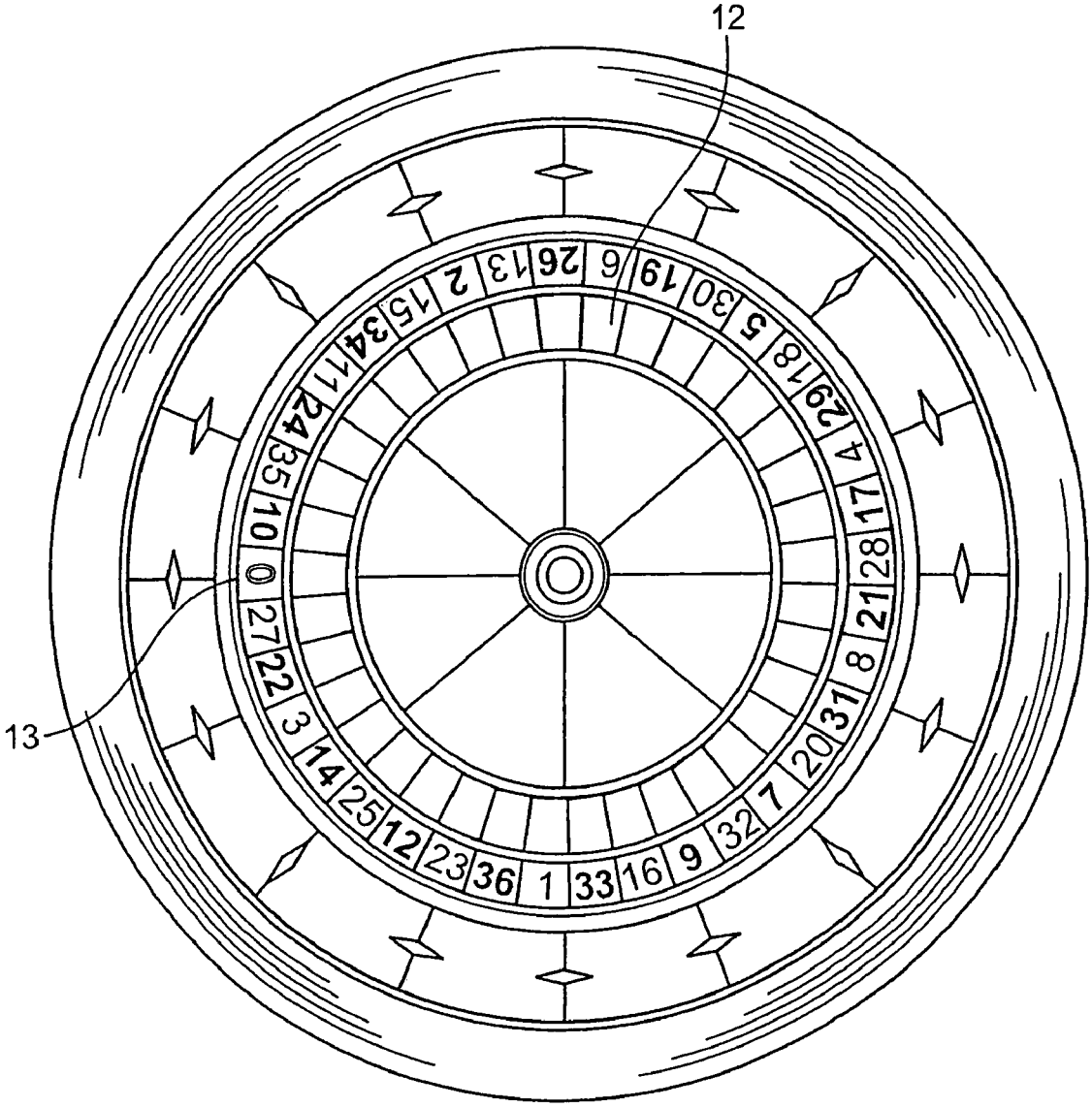
FIG. 8 shows another European roulette wheel arrangement for use with the game surface 10' shown in FIG. 4, according to an embodiment of the invention.

FIGS. 5 and 7 show American style roulette wheel arrangements having two house numbers (0 and 00) disposed diametrically opposite one another. FIGS. 6 and 8 show European style roulette wheels. As shown, the European style wheels include one house number (0).

Figure 4:
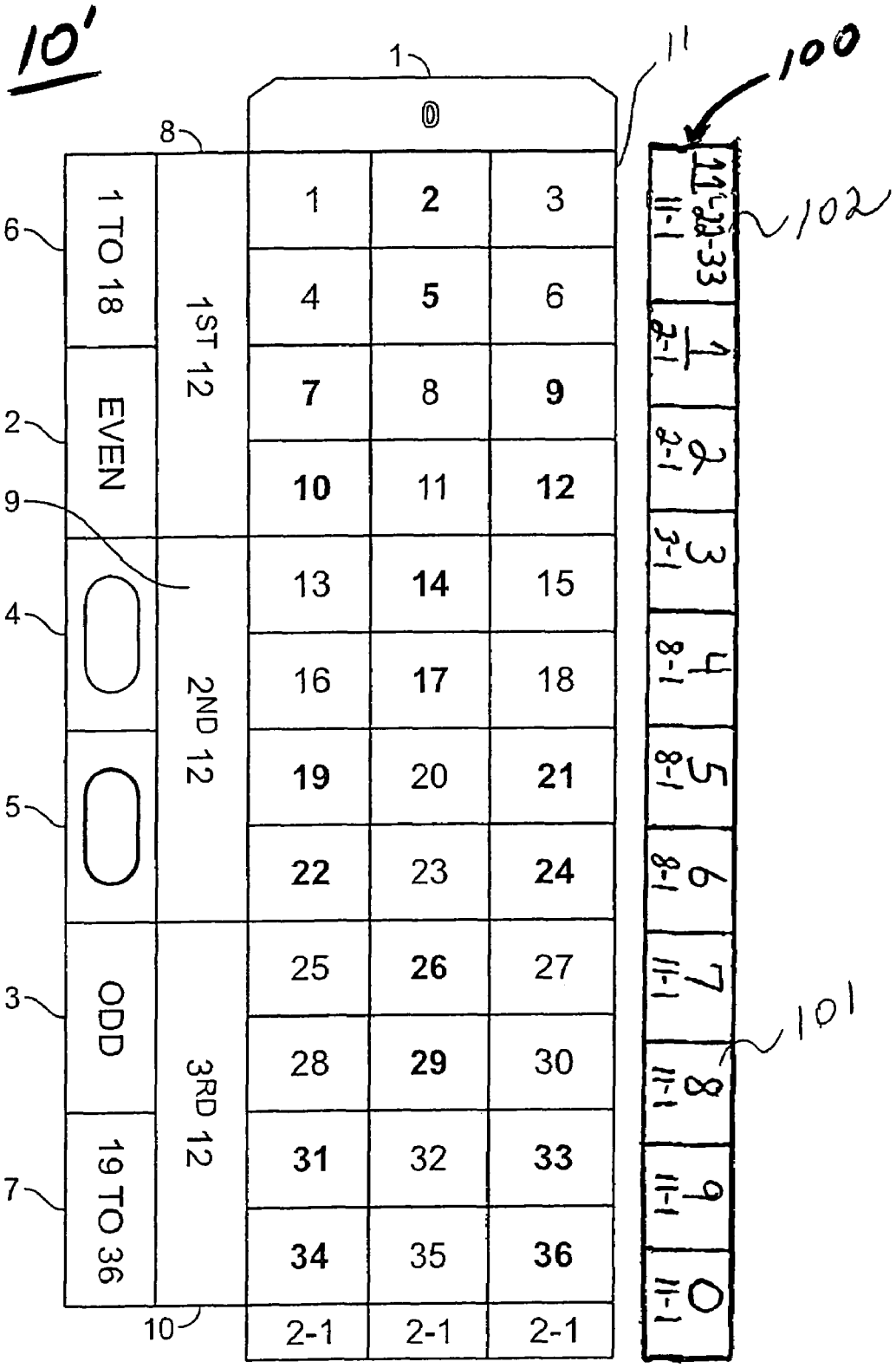
FIG. 4 shows a game surface 10' according to a further embodiment in combination with the additional side-betting area 100 of the invention.
Figure 9:
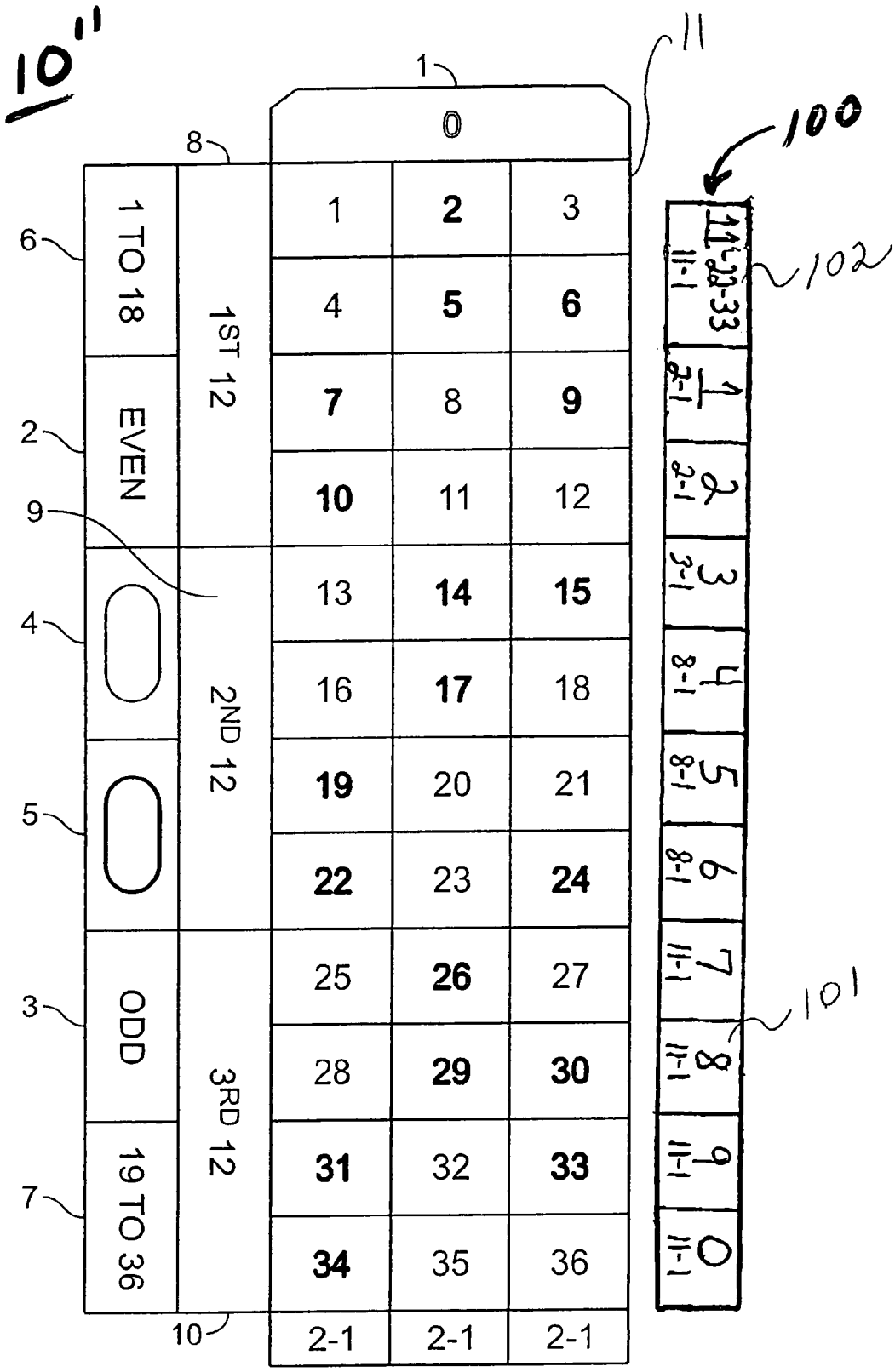
FIG. 9 shows a game surface 10" according to a further embodiment in combination with the additional side-betting area 100 of the invention.
Figure 10:
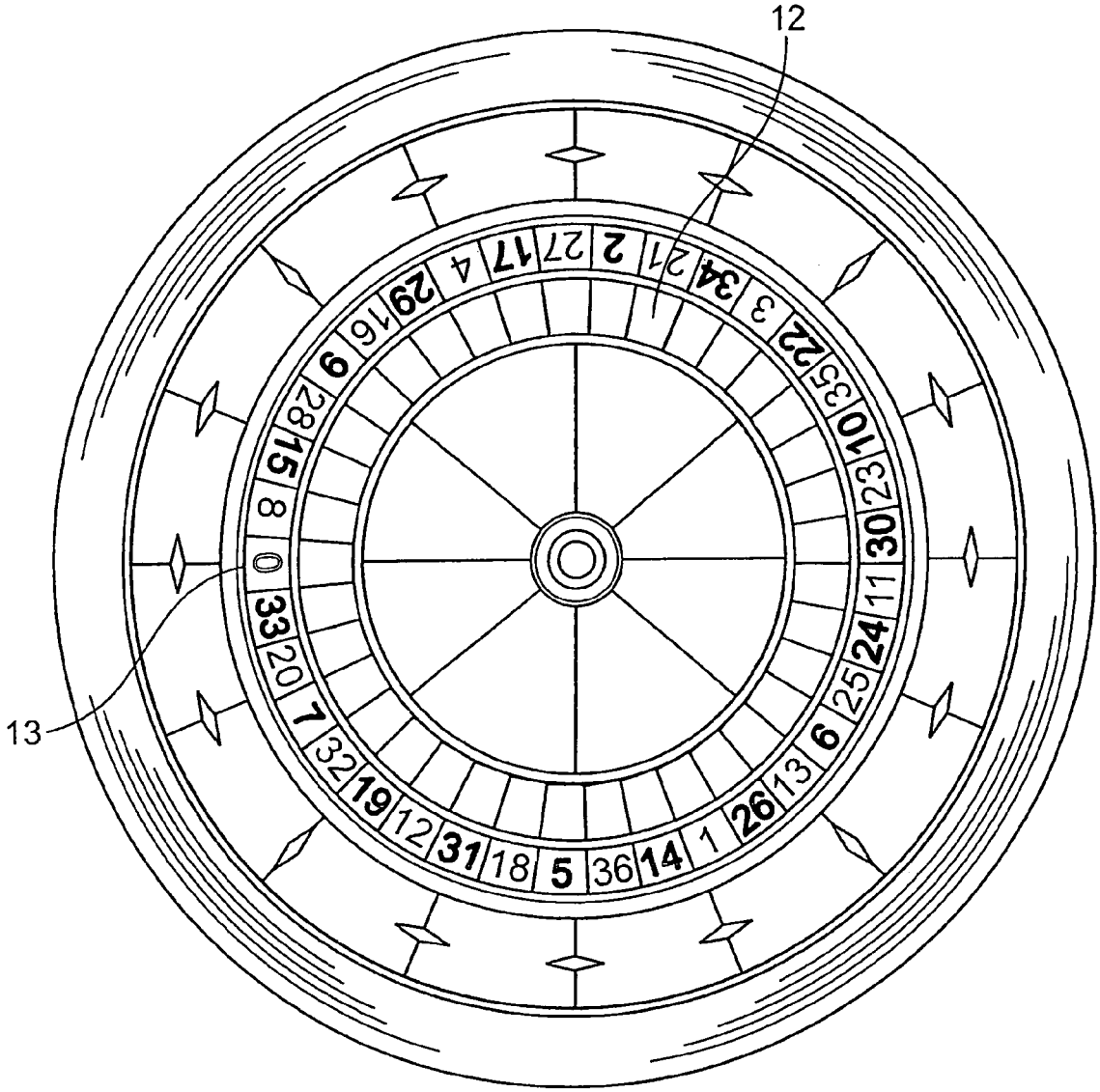
FIG. 10 shows a European roulette wheel arrangement for use with the game surface 10" shown in FIG. 9, according to an embodiment of the invention.

As illustrated in FIGS. 4, 9 and 1, game surfaces for use with additional wagering area 100 of the invention include one or more house number wagering areas 1 for placing a wager on a house number. The game surfaces also include an even number wagering area 2 for wagering on the even numbers (2, 4, 6, 8, 10, 12, 14, 16, 18, 20, 22, 24, 26, 28, 30, 32, 34 and 36) and an odd number wagering area 3 for wagering on the odd numbers (1, 3, 5, 7, 9, 11, 13, 15, 17, 19, 21, 23, 25, 27, 29, 31, 33 and 35). The game surface further includes a first color wagering area 4 for wagering on numbers associated with a first color, for example red, and a second color wagering area 5 for wagering on numbers associated with a second color, for example black.

Figure 11:
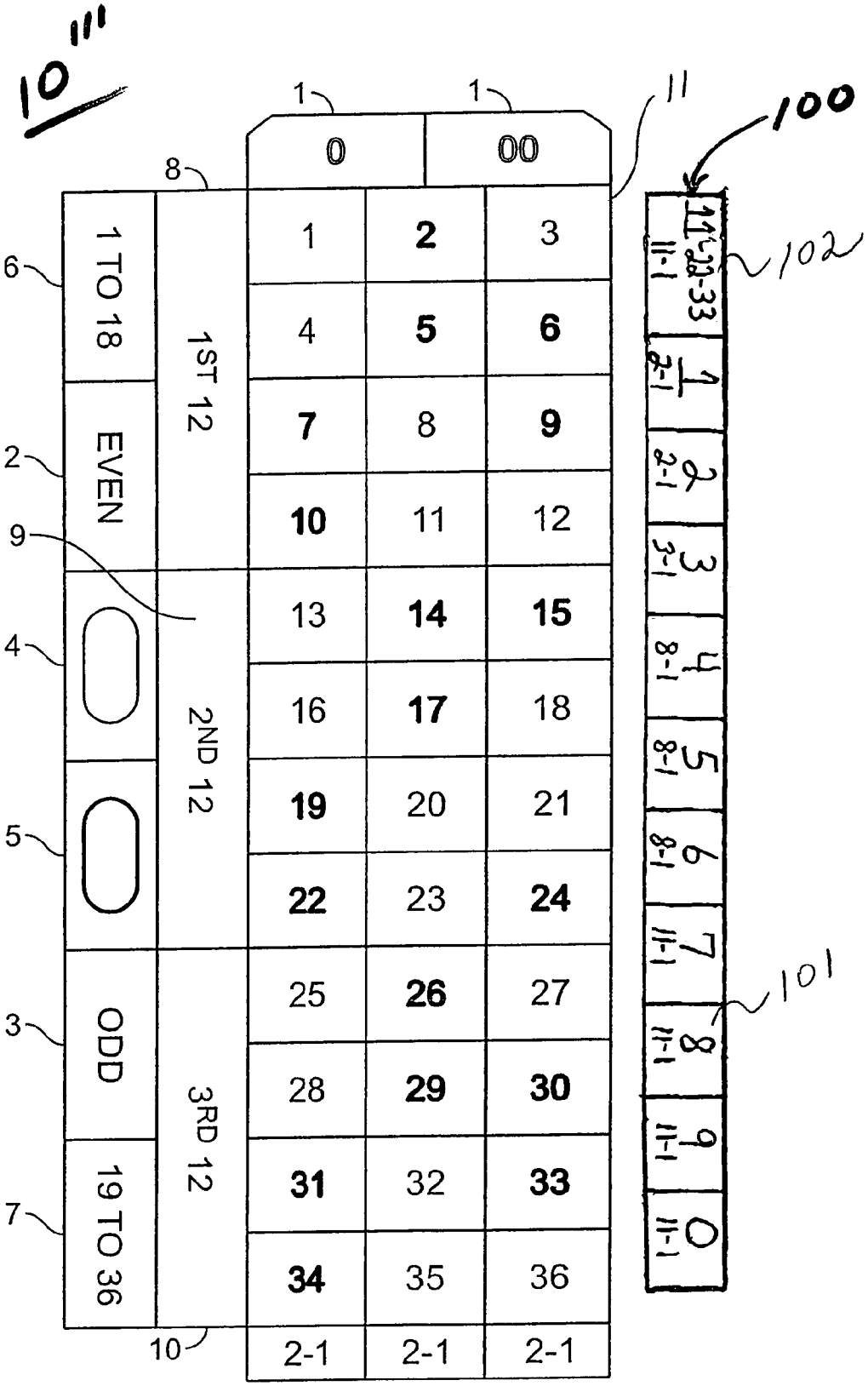
FIG. 11 shows a game surface 10''' according to a further embodiment in combination with the additional side-betting area 100 of the invention.
Figure 12:
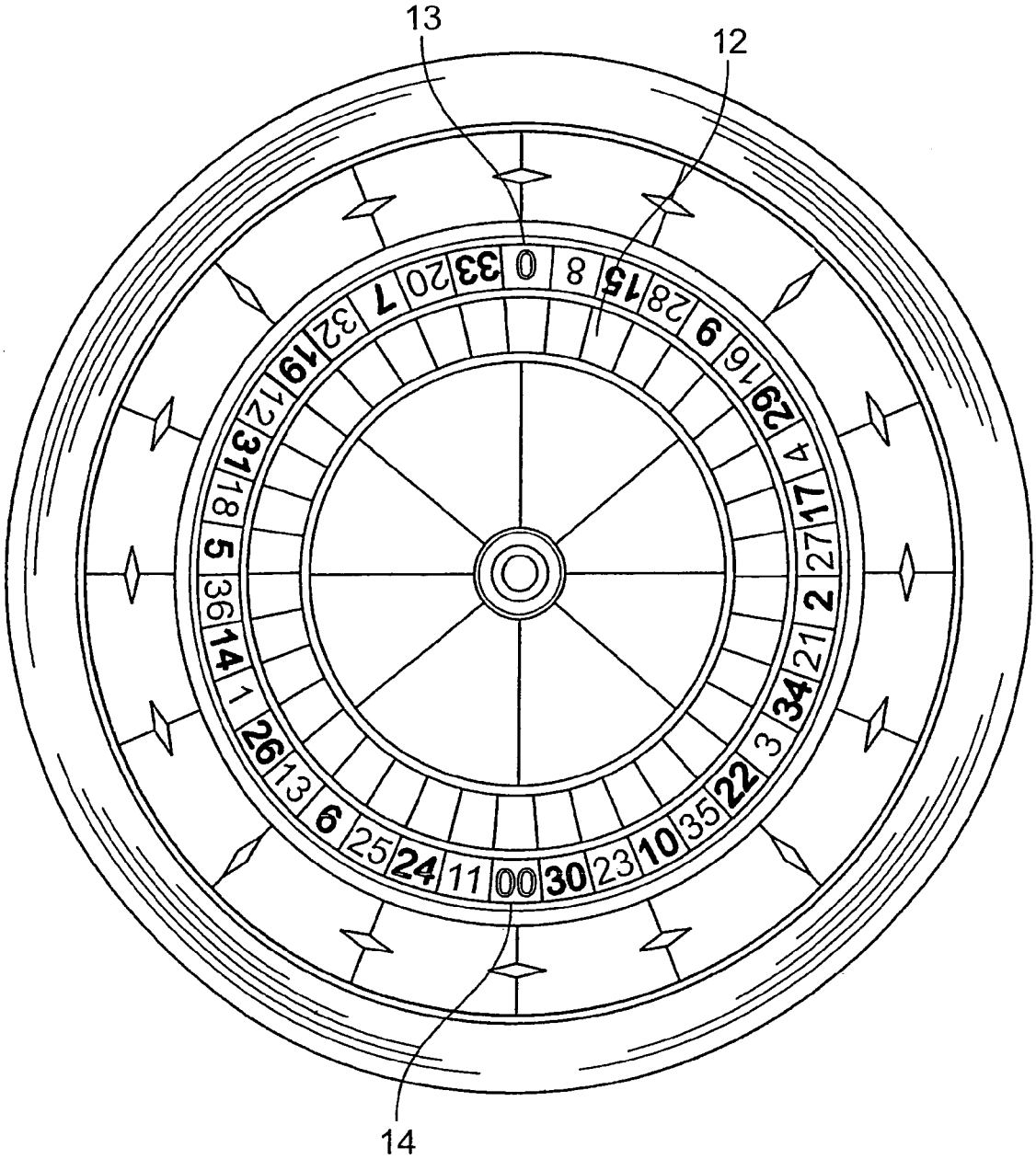
FIG. 12 shows an American roulette wheel arrangement for use with the game surface 10''' shown in FIG. 11, according to an embodiment of the invention.

The game surfaces 10', 10", and 10'" of FIGS. 4, 9 and 11, respectively, includes a low number wagering area 6 for wagering on the numbers from 1 to 18 and a high number wagering area 7 for wagering on the numbers from 19 to 36. A first dozen wagering area 8 for wagering on the numbers from 1 to 12, a second dozen wagering area 9 for wagering on the numbers from 13 to 24, and a third dozen wagering area 10 for wagering on the numbers from 25 to 36 are also disposed on the game surface.

Thirty-six individual number wagering areas 1, each corresponding to a whole number from 1 to 36 are arranged on the game surface. As shown, the thirty-six individual number wagering areas are arranged in ascending order from left to right in a matrix of three columns and twelve rows.

As shown in FIGS. 4, 9, and 11, in the game board surfaces shown, the thirty six individual whole numbers are evenly distributed in a perfectly balanced manner wherein nine odd numbers are associated with a first color (for example red), nine odd numbers are associated with a second color (for example black), nine even numbers are associated with a first color (for example red) and nine even numbers are associated with a second color (for example black)

Moreover, each of the three columns in the game surfaces comprises six numbers associated with the first color and six numbers associated with the second color. For example, each of the columns in the game surface of FIG. 4 comprises six odd numbers and six even numbers. Each of the columns in the game surface of FIG. 4 comprises three even numbers associated with the first color, three even numbers associated with the second color, three odd numbers associated with the first color and three odd numbers associated with the second color.

Additionally, each of the three groups of twelve numbers corresponding to the first, second and third dozen wagering areas in the game surface of FIG. 4 comprises three even numbers associated with the first color, three even numbers associated with the second color, three odd numbers associated with the first color and three odd numbers associated with the second color.

For example, as shown in the game surface 10' illustrated in FIG. 4, individual number wagering areas corresponding to numbers 1, 3, 4, 6, 8, 11, 13, 15, 16, 18, 20, 23, 25, 27, 28, 30, 32 and 35 are associated with a first color, and individual number wagering areas corresponding to numbers 2, 5, 7, 9, 10, 12, 14, 17, 19, 21, 22, 24, 26, 29, 31, 33, 34 and 36 are associated with a second color. Likewise, in a first alternative game surface embodiment (not shown), individual number wagering areas corresponding to numbers 1, 2, 4, 9, 11, 12, 13, 14, 16, 21, 23, 24, 25, 26, 28, 33, 35 and 36 are associated with a first color, and individual number wagering areas corresponding to numbers 3, 5, 6, 7, 8, 10, 15, 17, 18, 19, 20, 22, 27, 29, 30, 31, 32 and 34 are associated with a second color.

Likewise, in a second alternative game surface embodiment (not shown), individual number wagering areas corresponding to numbers 1, 3, 5, 8, 10, 12, 14, 16, 18, 19, 21, 23, 25, 27, 29, 32, 34 and 36 are associated with a first color, and individual number wagering areas corresponding to numbers 2, 4, 6, 7, 9, 11, 13, 15, 17, 20, 22, 24, 26, 28, 30, 31, 33 and 35 are associated with a second color. Likewise, in a third alternative game surface embodiment (not shown), individual number wagering areas corresponding to numbers 1, 6, 8, 9, 10, 11, 13, 18, 20, 21, 22, 23, 25, 30, 32, 33, 34 and 35 are associated with a first color, and individual number wagering areas corresponding to numbers 2, 3, 4, 5, 7, 12, 14, 15, 16, 17, 19, 24, 26, 27, 28, 29, 31 and 36 are associated with a second color.

In the game surface embodiments 10' and 10" shown in FIGS. 9 and 11, respectively, individual number wagering areas corresponding to numbers 1, 3, 4, 8, 11, 12, 13, 16, 18, 20, 21, 23, 25, 27, 28, 32, 35 and 36 are associated with a first color, and individual number wagering areas corresponding to numbers 2, 5, 6, 7, 9, 10, 14, 15, 17, 19, 22, 24, 26, 29, 30, 31, 33 and 34 are associated with a second color.

FIGS. 5, 6, 7, 8, 10 and 12 show roulette wheel arrangements according to embodiments of the invention. As shown, each roulette wheel includes a plurality of pockets 12 disposed in a circumferential manner, For example the American style wheels shown in FIGS. 5, 7 and 12 may have thirty-eight pockets and the European style wheels shown in FIGS. 6, 8 and 10 may have thirty-seven pockets.

Each of the pockets 12 correspond to either a house number 13, 14 (0 for the European wheel, 0 and 00 for the American wheel) or to one of the whole numbers from 1 to 36. Each of the whole numbers on the wheel is associated with a first color or a second color conforming to the association of numbers and colors on a game surface to be used with the particular wheel.

In the game board surface 10' and roulette wheel embodiments depicted in FIGS. 4-8, the pockets and corresponding numbers on the roulette wheel are arranged such that no two adjacent numbers on the roulette wheel are associated with a same color, are disposed in a same group on an associated game surface, are disposed in a same column on an associated game surface, are disposed in a same row on an associated game surface, or are disposed adjacent one another on an associated game surface. In terms of the game surface, two adjacent numbers may be considered as two numbers which are directly above or below one another (for example 4 and 7), side by side (for example 5 and 6) or directly diagonal from one another (for example 10 and 8).

In the game board surfaces 10" and 10''' and corresponding roulette wheel embodiments depicted in FIGS. 9-12, the pockets and corresponding numbers on the roulette wheel are arranged such that no two adjacent numbers on the roulette wheel are associated with a same color, are disposed in a same group on an associated game surface, are disposed in a same column on an associated game surface, are disposed in a same row on an associated game surface, or are disposed adjacent one another on an associated game surface. Furthermore, as described in co-pending U.S. patent application Ser. No. 11/593,322, the contents of which are incorporated by reference, the pockets and corresponding numbers on the roulette wheel are arranged such that each pair of numbers disposed substantially diametrically across from one another on the roulette wheel is disposed in the same group on the game surface and in the same column on the game surface. The phrase substantially diametrically across from one another refers to numbers which are disposed on the roulette wheel opposite one another along a diameter of the wheel. For example, the following pairs of numbers on the roulette wheel arrangements shown in FIGS. 10 and 12 are considered to be disposed substantially diametrically across from one another: 33 and 30; 20 and 23; 7 and 10; 32 and 35; 19 and 22; 12 and 3; 31 and 34; 18 and 21; 5 and 2; 36 and 27; 14 and 17; 1 and 4; 26 and 29; 13 and 16; 6 and 9; 25 and 28; 24 and 15; and 11 and 8. Moreover, a roulette wheel according to this embodiment may be arranged such that all pairs of numbers disposed substantially diametrically across from one another on the roulette wheel are also touching each other on a corresponding game board except for three substantially diametrically opposite pairs, namely 12 and 3; 24 and 15; and 36 and 27.

As shown in FIG. 5, a roulette wheel arrangement corresponding to the game board surface 10' shown in FIG. 4, includes pockets arranged in the following clockwise sequence with respect to a corresponding number: a first house number, 22, 11, 36, 13, 2, 28, 21, 8, 33, 20, 31, 18, 7, 32, 12, 23, 34, 3, a second house number, 15, 26, 1, 24, 35, 9, 16, 29, 4, 17, 6, 19, 30, 5, 25, 14, 27 and 10.

As shown in FIG. 6, a further roulette wheel arrangement corresponding to the game board surface 10' shown in FIG. 4, includes pockets arranged in the following clockwise sequence with respect to a corresponding number: a house number, 15, 26, 1, 24, 35, 9, 16, 29, 4, 17, 6, 19, 30, 5, 25, 14, 27, 10, 3, 22, 11, 36, 13, 2, 28, 21, 8, 33, 20, 31, 18, 7, 32, 12, 23 and 34.

As shown in FIG. 7, a roulette wheel arrangement corresponding to the game board surface 10' shown in FIG. 4, includes pockets arranged in the following clockwise sequence with respect to a corresponding number: a first house number, 33, 20, 7, 30, 17, 6, 31, 18, 5, 27, 22, 11, 36, 13, 2, 25, 14, 3 a second house number, 10, 15, 26, 1, 24, 35, 12, 23, 34, 8, 19, 32, 9, 16, 29, 4, 21 and 28.

As shown in FIG. 8, a roulette wheel arrangement corresponding to the game board surface 10' shown in FIG. 4 includes pockets arranged in the following clockwise sequence with respect to a corresponding number: a house number, 10, 35, 24, 11, 34, 15, 2, 13, 26, 6, 19, 30, 5, 18, 29, 4, 17, 28, 21, 8, 31, 20, 7, 32, 9, 16, 33, 1, 36, 23, 12, 25, 14, 3, 22, and 27.

In an alternate roulette wheel arrangement (not shown) corresponding to the above-mentioned first alternative game surface embodiment (not shown), the pockets may be arranged in the following clockwise sequence with respect to a corresponding number: a house number, 34, 12, 19, 26, 15, 2, 27, 4, 17, 1, 30, 23, 10, 21, 32, 13, 8, 36, 7, 33, 20, 25, 18, 11, 22, 35, 6, 28, 3, 14, 31, 24, 5, 16, 29 and 9.

Likewise, in an alternate roulette wheel arrangement (not shown) corresponding to above-mentioned first alternative game surface embodiment (not shown), the pockets may be arranged in the following clockwise sequence with respect to a corresponding number: a first house number, 7, 33, 20, 25, 18, 11, 22, 35, 6, 28, 3, 14, 31, 24, 5, 16, 29, 9, a second house number, 34, 12, 19, 26, 15, 2, 27, 4, 17, 1, 30, 23, 10, 21, 32, 13, 8 and 36.

In a roulette wheel arrangement (not shown) corresponding to above-mentioned second alternative game surface embodiment (not shown), the pockets may be arranged in the following clockwise sequence with respect to a corresponding number: a house number, 24, 29, 6, 19, 30, 1, 20, 25, 2, 16, 33, 10, 35, 18, 7, 32, 13, 8, 15, 34, 9, 14, 31, 12, 17, 36, 11, 21, 28, 3, 22, 27, 4, 23, 30 and 5.

Likewise, in a roulette wheel arrangement (not shown) corresponding to above-mentioned second alternative game surface embodiment (not shown), the pocket may be arranged in the following clockwise sequence with respect to a corresponding number: a first house number, 15, 34, 9, 14, 31, 12, 17, 36, 11, 21, 28, 3, 22, 27, 4, 23, 30, 5, a second house number, 24, 29, 6, 19, 30, 1, 20, 25, 2, 16, 33, 10, 35, 18, 7, 32, 13, and 8.

In a roulette wheel arrangement (not shown) corresponding to above-mentioned third alternative game surface embodiment (not shown), the pockets may be arranged in the following clockwise sequence with respect to a corresponding number: a first house number, 29, 18, 7, 30, 17, 10, 27, 22, 5, 25, 14, 1, 36, 23, 12, 35, 24, 11, a second house number, 26, 13, 2, 33, 16, 9, 28, 21, 4, 32, 19, 8, 15, 34, 3, 20, 31 and 6.

Likewise, in a further roulette wheel arrangement (not shown) corresponding to above-mentioned third alternative game surface embodiment (not shown), the pockets may be arranged in the following clockwise sequence with respect to a corresponding number: a house number, 26, 13, 2, 33, 16, 9, 28, 21, 4, 32, 19, 8, 15, 34, 3, 20, 31, 6, 29, 18, 7, 30, 17, 10, 27, 22, 5, 25, 14, 1, 36, 23, 12, 35, 24, and 11.

Likewise, in a roulette wheel arrangement (not shown) corresponding to above-mentioned third alternative game surface embodiment (not shown), the pockets may be arranged in the following clockwise sequence with respect to a corresponding number: a first house number, 29, 18, 5, 34, 17, 10, 27, 22, 3, 25, 14, 1, 26, 21, 4, 35, 24, 11, a second house number, 36, 13, 2, 33, 16, 9, 28, 23, 12, 32, 15, 8, 31, 20, 7, 30, 19 and 6.

Likewise, in a roulette wheel arrangement (not shown) corresponding to above-mentioned third alternative game surface embodiment (not shown), the pockets may be arranged in the following clockwise sequence with respect to a corresponding number: a house number, 36, 13, 2, 33, 16, 9, 28, 23, 12, 32, 15, 8, 31, 20, 7, 30, 19, 6, 29, 18, 5, 34, 17, 10, 27, 22, 3, 25, 14, 1, 26, 21, 4, 35, 24 and 11.

Likewise, in a roulette wheel arrangement (not shown) corresponding to above-mentioned third alternative game surface embodiment (not shown), the pockets may be arranged in the following clockwise sequence with respect to a corresponding number: a first house number, 30, 19, 6, 31, 20, 7, 32, 15, 8, 27, 22, 3, 34, 17, 10, 29, 18, 5, a second house number, 36, 13, 2, 33, 16, 9, 28, 23, 12, 25, 14, 1, 26, 21, 4, 35, 24, and 11.

Likewise, in a roulette wheel arrangement (not shown) corresponding to above-mentioned third alternative game surface embodiment (not shown), the pockets may be arranged in the following clockwise sequence with respect to a corresponding number: a house number, 30, 19, 6, 31, 20, 7, 32, 15, 8, 27, 11, 24, 35, 4, 21, 26, 1, 14, 25, 12, 23, 28, 9, 16, 33, 2, 13, 36, 22, 3, 34, 17, 10, 29, 18 and 5.

Likewise, in a roulette wheel arrangement (not shown) corresponding to above-mentioned third alternative game surface embodiment (not shown), the pockets may be arranged in the following clockwise sequence with respect to a corresponding number: a first house number, 29, 18, 5, 34, 17, 10, 27, 22, 3, 32, 24, 1, 26, 21, 4, 33, 16, 11, a second house number, 36, 13, 2, 25, 14, 9, 28, 23, 12, 35, 15, 8, 31, 20, 7, 30, 19 and 6.

Likewise, in a roulette wheel arrangement (not shown) corresponding to above-mentioned third alternative game surface embodiment (not shown), the pockets may be arranged in the following clockwise sequence with respect to a corresponding number: a house number, 36, 13, 2, 25, 14, 9, 28, 23, 12, 35, 15, 8, 31, 20, 7, 30, 19, 6, 29, 18, 5, 34, 17, 10, 27, 22, 3, 32, 24, 1, 26, 21, 4, 33, 16 and 11.

As shown in FIG. 10, the pockets may be arranged in the following clockwise sequence with respect to a corresponding number: a house number, 8, 15, 28, 9, 16, 29, 4, 17, 27, 2, 21, 34, 3, 22, 35, 10, 23, 30, 11, 24, 25, 6, 13, 26, 1, 14, 36, 5, 18, 31, 12, 19, 32, 7, 20, and 33.

As shown in FIG. 12, the pockets may be arranged in the following clockwise sequence with respect to a corresponding number: a first house number, 8, 15, 28, 9, 16, 29, 4, 17, 27, 2, 21, 34, 3, 22, 35, 10, 23, 30, a second house number, 11, 24, 25, 6, 13, 26, 1, 14, 36, 5, 18, 31, 12, 19, 32, 7, 20 and 33.

A further advantage of the embodiments of the roulette wheel arrangements is that the sequence of numbers on an American style roulette wheel is substantially the same as the sequence of numbers on a European style wheel for use with the same game surface.

For example, the sequence of numbers on the American style wheel shown in FIG. 12 is substantially the same as the sequence on the European style wheel shown in FIG. 10. The only difference in the pairs of wheels is the placement of the additional house number (00) in the American style wheels.

A further advantage of a roulette game surface and wheel arrangement according to an embodiment of the invention is that the arrangement of numbers, colors and odd and even numbers is significantly more balanced than in the prior art arrangements.

For example, in the arrangements shown in FIGS. 9-12 the sum of the nine odd black numbers (5, 7, 9, 15, 17, 19, 29, 31, and 33) equals 165, and the sum of the nine odd red numbers (1, 3, 11, 13, 21, 23, 25, 27, and 35) equals 159, giving a total of 324 as the sum of the odd numbers. The sum of the nine even black numbers in the arrangements shown in FIGS. 9-12 (2, 6, 10, 14, 22, 24, 26, 30 and 34) equals 168 and the sum of the nine even red numbers (4, 8, 12, 16, 18, 20, 28, 32 and 36) equals 174, giving a total of 342 as the sum of the even numbers. Additionally, the sum of the nine black odd numbers (165) and the nine black even numbers (168) equals 333, which is the same as the sum of the nine red odd numbers (159) and the nine red even numbers (174). These relationships are true for both the American and European arrangements.

Additionally, in the American wheel arrangement shown in FIG. 12, the sum of the odd numbers on one side of the wheel between the 0 and 00 positions (15, 9, 29, 17, 27, 21, 3, 35, and 23) equals 179 and the sum of the even numbers on the same half of the wheel (8, 28, 16, 4, 2, 34, 22, 10 and 30) is 154, giving a total of 333. The sum of the odd numbers between the 0 and 00 positions on the opposite side of the wheel (11, 25, 13, 1, 5, 31, 19, 7, and 33) is 145 and the sum of the even numbers on the same half of the wheel (24, 6, 26, 14, 36, 18, 12, 32, and 20) is 188, also giving a total of 333. Thus the wheel is perfectly balanced.

As mentioned, the side betting game may be combined with a new balanced type of Roulette wheel game as described in Applicant's co-pending U.S. patent application Ser. No. 11/725,073 entitled SUPER ROULETTE WHEEL.

Figure 13A:
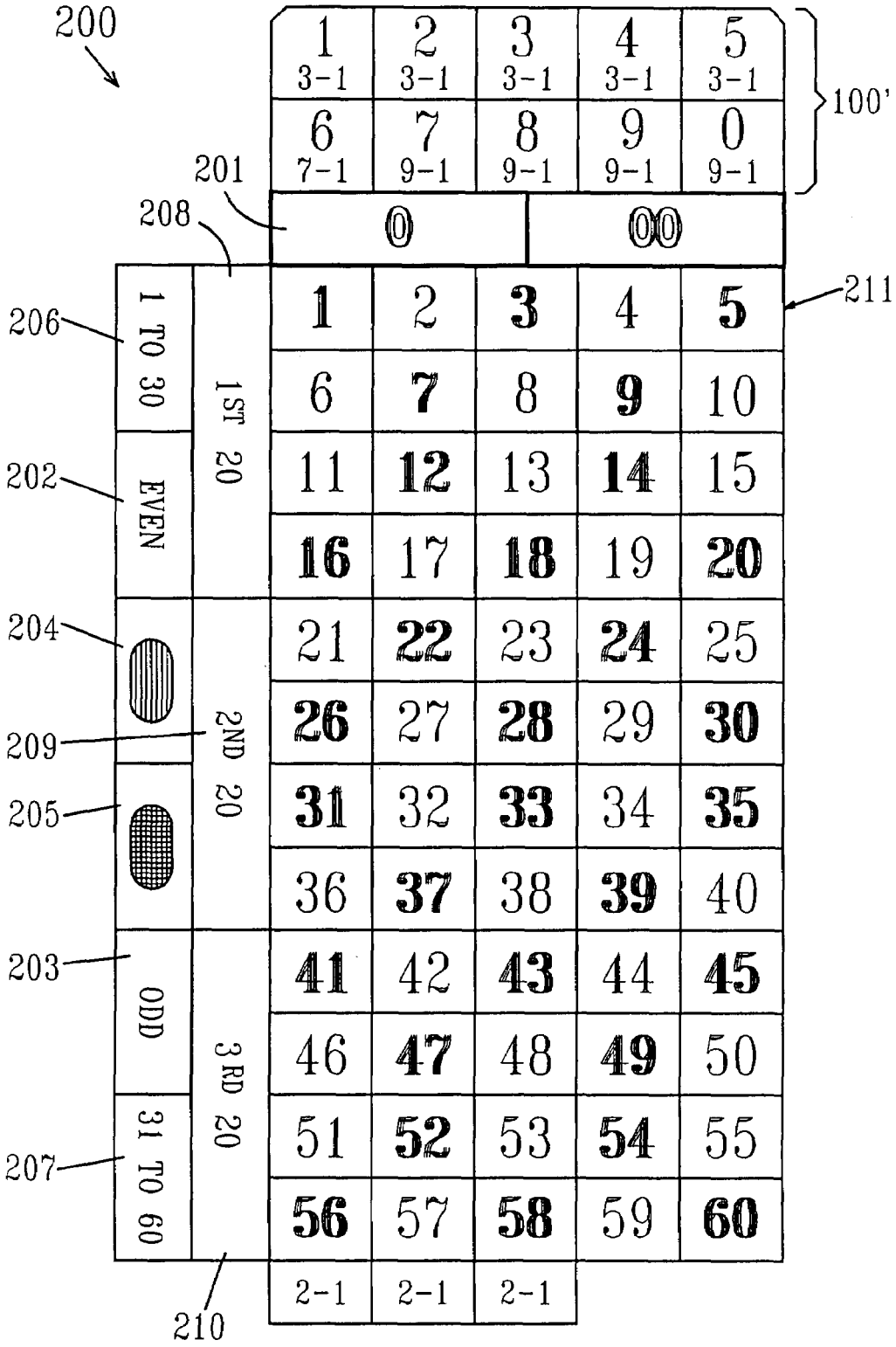
FIGS. 13A and 13B illustrate respective SUPER ROULETTE game surfaces or boards 200, 250 in combination with an additional wagering (side-bet) area 100' according to the present invention.
Figure 14:
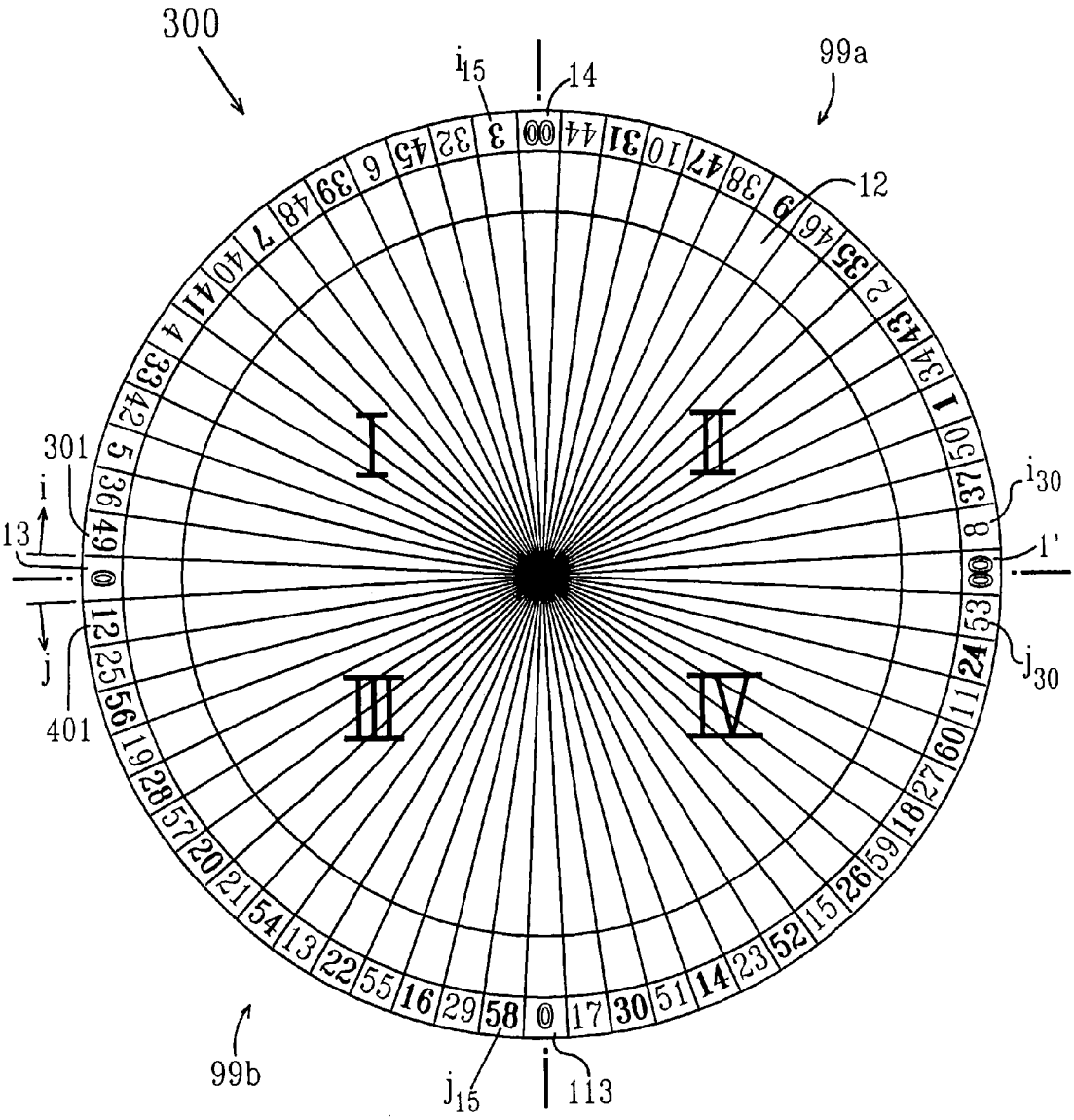
FIG. 14 depicts an example roulette wheel arrangement 300 corresponding to the game board surface 200 of FIG. 13A.
Figure 15:
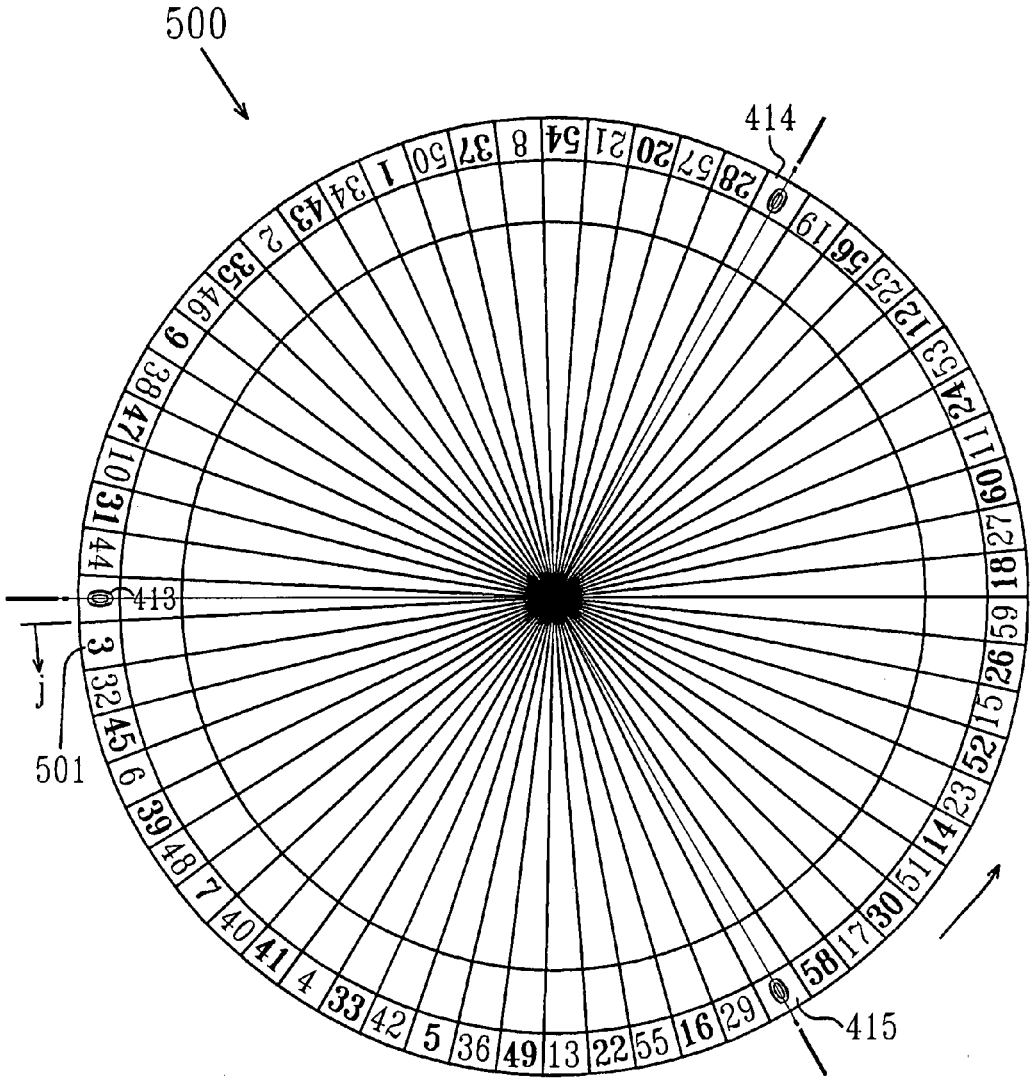
FIG. 15 depicts a further example roulette wheel arrangement 500 corresponding to the game board surface 200 of FIG. 13.

FIG. 13A illustrates a SUPER ROULETTE game surface or board 200 in combination with an additional wagering (side-bet) area 100' of the present invention. In the game surface embodiment of FIG. 13A, there is included 60 individual number waging areas arranged on the game surface. FIGS. 14 and 15 show roulette wheel arrangements suitable for use with the game surface 200 shown in FIG. 13A. The additional wagering area 100' shown in FIG. 13A corresponds to the additional wagering area 100 shown in FIG. 1, however, it does not include the box 102 in order to ensure the ten additional wagering boxes in additional wagering area 100' adheres to the established house advantage. While the additional wagering area 100' shown in FIG. 13A is in a different configuration and location with respect to the Roulette game surface as compared to the configuration and location of additional wagering area 100 of FIG. 1, this configuration/location is by way of example, and not so limiting.

As illustrated in FIG. 13A, the game surface 200 incorporating additional wagering area 100' according to a further embodiment of the invention, includes two (2) house number wagering areas 201 for placing a wager on a house number. The game surfaces also include an even number wagering area 202 for wagering on the even numbers (2, 4, 6, 8, 10, 12, 14, 16, 18, 20, 22, 24, 26, 28, 30, 32, 34, 36, 38, 40, 42, 44, 46, 48, 50, 52, 54, 56, 58 and 60) and an odd number wagering area 203 for wagering on the odd numbers (1, 3, 5, 7, 9, 11, 13, 15, 17, 19, 21, 23, 25, 27, 29, 31, 33, 35, 37, 39, 41, 43, 45, 47, 49, 51, 53, 55, 57, 59). The game surface further includes a first color wagering area 204 for wagering on numbers associated with a first color, for example red, and a second color wagering area 205 for wagering on numbers associated with a second color, for example black.

A game surface according to an embodiment of the invention further includes a low number wagering area 206 for wagering on the numbers from 1 to 30 and a high number wagering area 207 for wagering on the numbers from 31 to 60. A first other wagering area 208 for wagering on the numbers from 1 to 20, a second other wagering area 209 for wagering on the numbers from 21 to 40, and a third other wagering area 210 for wagering on the numbers from 41 to 60 are also disposed on the game surface.

Sixty individual number wagering areas 211, each corresponding to a whole number from 1 to 60 are arranged on the game surface. As shown, the sixty individual number wagering areas are arranged in ascending order from left to right in a matrix of five columns and twelve rows.

As shown in FIG. 13A, in a game surface according to an embodiment of the invention, the sixty individual whole numbers are evenly distributed in a perfectly balanced manner wherein fifteen odd numbers are associated with a first color (for example red), fifteen odd numbers are associated with a second color (for example black), fifteen even numbers are associated with a first color (for example red) and fifteen even numbers are associated with a second color (for example black).

Moreover, each of the five columns in the game surface 200 comprises six numbers associated with the first color and six numbers associated with the second color. Each of the columns in a game surface according to an embodiment of the invention comprises six odd numbers and six even numbers. Each of the columns in a game surface according to an embodiment of the invention comprises three even numbers associated with the first color, three even numbers associated with the second color, three odd numbers associated with the first color and three odd numbers associated with the second color.

Additionally, each of the three groups of twenty numbers corresponding to the first, second and third other wagering areas in the game surface 200 as shown in FIG. 13A comprises five even numbers associated with the first color, five even numbers associated with the second color, five odd numbers associated with the first color and five odd numbers associated with the second color.

For example, as shown in the game surface 200 illustrated in FIG. 13A, individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 are associated with a first color (e.g., black), and individual number wagering areas corresponding to numbers 2, 4, 6, 8, 10, 11, 13, 15, 17, 19, 21, 23, 25, 27, 29, 32, 34, 36, 38, 40, 42, 44, 46, 48, 50, 51, 53, 55, 57 and 59 are associated with a second color (e.g., red).

Without any limitation, it is understood that individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 may be associated with a first color (e.g., red), and individual number wagering areas corresponding to numbers 2, 4, 6, 8, 10, 11, 13, 15, 17, 19, 21, 23, 25, 27, 29, 32, 34, 36, 38, 40, 42, 44, 46, 48, 50, 51, 53, 55, 57 and 59 may be associated with a second color (e.g., black).

Figure 13B:
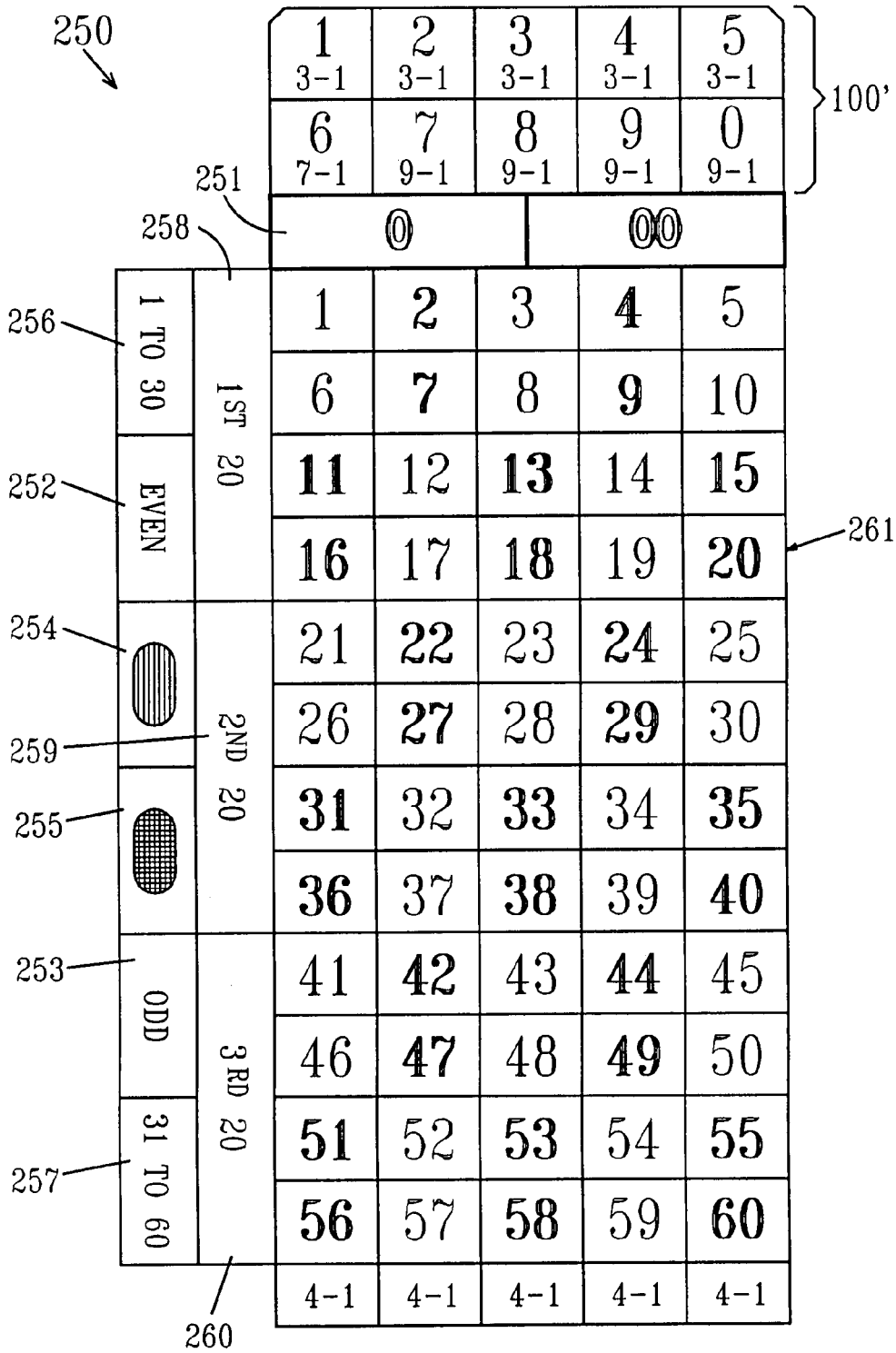

As illustrated in FIG. 13B, an alternative roulette game surface 250 incorporating additional wagering area 100' according to the invention, includes two (2) house number wagering areas 251 for placing a wager on a house number. The game surfaces also include an even number wagering area 252 for wagering on the even numbers (2, 4, 6, 8, 10, 12, 14, 16, 18, 20, 22, 24, 26, 28, 30, 32, 34, 36, 38, 40, 42, 44, 46, 48, 50, 52, 54, 56, 58 and 60) and an odd number wagering area 253 for wagering on the odd numbers (1, 3, 5, 7, 9, 11, 13, 15, 17, 19, 21, 23, 25, 27, 29, 31, 33, 35, 37, 39, 41, 43, 45, 47, 49, 51, 53, 55, 57, 59). The game surface further includes a first color wagering area 254 for wagering on numbers associated with a first color, for example red, and a second color wagering area 255 for wagering on numbers associated with a second color, for example black.

A game surface according to an embodiment of the invention further includes a low number wagering area 256 for wagering on the numbers from 1 to 30 and a high number wagering area 257 for wagering on the numbers from 31 to 60. A first other wagering area 258 for wagering on the numbers from 1 to 20, a second other wagering area 259 for wagering on the numbers from 21 to 40, and a third other wagering area 260 for wagering on the numbers from 41 to 60 are also disposed on the game surface.

Sixty individual number wagering areas 261, each corresponding to a whole number from 1 to 60 are arranged on the game surface. As shown, the sixty individual number wagering areas are arranged in ascending order from left to right in a matrix of five columns and twelve rows.

As shown in FIG. 13B, in a game surface according to an embodiment of the invention, the sixty individual whole numbers are evenly distributed in a perfectly balanced manner wherein fifteen odd numbers are associated with a first color (for example red), fifteen odd numbers are associated with a second color (for example black), fifteen even numbers are associated with a first color (for example red) and fifteen even numbers are associated with a second color (for example black).

Moreover, each of the five columns in the game surface 250 comprises six numbers associated with the first color and six numbers associated with the second color. Each of the columns in a game surface according to an embodiment of the invention comprises six odd numbers and six even numbers. Each of the columns in a game surface according to an embodiment of the invention comprises three even numbers associated with the first color, three even numbers associated with the second color, three odd numbers associated with the first color and three odd numbers associated with the second color.

Additionally, each of the three groups of twenty numbers corresponding to the first, second and third other wagering areas in the game surface 250 as shown in FIG. 13B comprises five even numbers associated with the first color, five even numbers associated with the second color, five odd numbers associated with the first color and five odd numbers associated with the second color.

In a further demonstration of balancing in the game surface embodiment of FIG. 13B, one half of the sixty individual number wagering areas 261, e.g., wagering areas numbered 1-30, include seven black odd numbers (7, 9, 11, 13, 15, 27 and 29) and include seven black even numbers (2, 4, 16, 18, 20, 22 and 24). Similarly, the same half including wagering areas numbered 1-30 include eight red odd numbers (1, 3, 5, 17, 19, 21, 23, and 25) and include eight red even numbers (6, 8, 10, 12, 14, 26, 28 and 30). Similarly, the other half of the sixty individual number wagering areas 261, e.g., wagering areas numbered 31-60, include eight black odd numbers (31, 33, 35, 47, 49, 51, 53 and 55) and include eight black even numbers (36, 38, 40, 42, 44, 56, 58 and 60). Similarly, the same half including wagering areas numbered 31-60 include seven red odd numbers (37, 39, 41, 43, 45, 57, and 59) and include seven red even numbers (32, 34, 46, 48, 50, 52 and 54).

For example, as shown in the game surface 250 illustrated in FIG. 13B, individual number wagering areas corresponding to numbers 1, 3, 5, 6, 8, 10, 12, 14, 17, 19, 21, 23, 25, 26, 28, 30, 32, 34, 37, 39, 41, 43, 45, 46, 48, 50, 52, 54, 57 and 59 are associated with a first color (e.g., red), and individual number wagering areas corresponding to numbers 2, 4, 7, 9, 11, 13, 15, 16, 18, 20, 22, 24, 27, 29, 31, 33, 35, 36, 38, 40, 42, 44, 47, 49, 51, 53, 56, 58 and 60 are associated with a second color (e.g., black). It is understood that the color scheme for the numbers may be reversed, i.e., individual number wagering areas corresponding to numbers 1, 3, 5, 6, 8, 10, 12, 14, 17, 19, 21, 23, 25, 26, 28, 30, 32, 34, 37, 39, 41, 43, 45, 46, 48, 50, 52, 54, 57 and 59 may be associated with a first color (e.g., black), and individual number wagering areas corresponding to numbers 2, 4, 7, 9, 11, 13, 15, 16, 18, 20, 22, 24, 27, 29, 31, 33, 35, 36, 38, 40, 42, 44, 47, 49, 51, 53, 56, 58 and 60 may be associated with a second color (e.g., red).

FIG. 14 depicts an example roulette wheel arrangement 300 corresponding to the game board surface 200 of FIG. 13A. As shown, the roulette wheel 300 includes a plurality of pockets 12 disposed in a circumferential manner, for example the wheel shown in FIG. 14 may have sixty four pockets.

As shown in FIG. 14, each of the pockets 12 correspond to either a house number 13, 113, 14, 114 or, to one of the whole numbers from 1 to 60. Each of the whole numbers on the wheel is associated with a first color or a second color conforming to the association of numbers and colors on a game surface to be used with the particular wheel. It should be understood that while four house numbers (13, 113, 14, 114) are shown in the embodiments depicted in FIG. 14, it is understood that two diametrically opposed house numbers, (e.g., 14, 113) may be omitted, thus, leaving only two house numbers for these embodiments.

It is understood that, for the roulette wheel arrangement shown in FIG. 14, the wheel may have four house numbers, e.g., two 0s and two 00s or, 40s or, 4 00s or combination thereof disposed diametrically opposite one another. In other embodiments, there may be three or less house numbers.

According to a further embodiment of the invention, the pockets and corresponding numbers on the roulette wheel 300 as shown in FIG. 14, are arranged such that each number at a pocket location "i", i=1, . . . , 30 when traversing clockwise one half 99*a* of the roulette wheel beginning at a first pocket location 301 as shown in FIG. 14, and, a corresponding positioned pocket location "j", j=1, . . . , 30 (number) when traversing the roulette wheel counter-clockwise beginning at a corresponding first pocket location 401 the other half 99*b* of the roulette wheel will add up to sixty one for each pair of like positioned numbers. That is, $i_1+j_1=61$, $i_2+j_2=61$, . . . $i_{30}+j_{30}=61$ etc. For example, the following pairs of numbers on the roulette wheel arrangements shown in FIG. 14 meet this criteria: 49 and 12; 36 and 25; 5 and 56; 42 and 19; 33 and 28; 4 and 57; 41 and 20; 40 and 21; 7 and 54; 48 and 13, etc; . . . ; 1 and 60; 50 and 11; 37 and 24; and 8 and 53;. Moreover, it is further shown that each corresponding positioned number pair that adds to 61 are of the same color, e.g., values 49 and 12, 36 and 25, etc.

Thus, as shown in FIG. 14, the pockets i=1, . . . , 30 when traversing the half 99*a* of the roulette wheel clockwise beginning at a first location 301 as shown in FIG. 14, may be arranged in the following clockwise sequence with respect to a corresponding number: a first house number, 49, 36, 5, 42, 33, 4, 41, 40, 7, 48, 39, 6, 45, 32 and 3, a second house number, 44, 31, 10, 47, 38, 9, 46, 35, 2, 43, 34, 1, 50, 37 and 8. Likewise, as shown in FIG. 14, the pockets j=1, . . . , 30 when traversing a second half of the roulette wheel counter-clockwise beginning at the first location 401, corresponding to the first location 301 as shown in FIG. 5, may be arranged in the following counter-clockwise sequence with respect to a corresponding $i^{th}$ pocket number: 12, 25, 56, 19, 28, 57, 20, 21, 54, 13, 22, 55, 16, 29 and 58, a third house number, 17, 30, 51, 14, 23, 52, 15, 26, 59, 18, 27, 60, 11, 24 and 53.

In this example roulette wheel arrangement shown in FIG. 14, the first number value, e.g., 49, placed in the one half 99*a* of the roulette wheel beginning at a first pocket location 301 corresponds to a location in Group 3, Col. 4 of the corresponding game surface board of FIG. 13A; the second value is chosen to correspond to any different group and column number of the game board surface of FIG. 13A, e.g., Group 2, Col., 1 and, is of the second color. The consecutive $i^{th}$ pocket number values at each location starting from location 301 in FIG. 14, conform to a repeating pattern of Group and Columns of the corresponding game board surface of FIG. 13A, from left to right as follows:

| GROUP | Col. |
|---|---|
| 3 | 4 |
| 2 | 1 |
| 1 | 5 |
| 3 | 2 |
| 2 | 3 |
| 1 | 4 |
| 3 | 1 |
| 2 | 5 |
| 1 | 2 |
| . | . |
| . | . |
| . | . |
| . | . |
| . | . |
| . | . |

Likewise, in this example roulette wheel arrangement shown in FIG. 14, the first number value at the first pocket location 401 of the other half 99*b* of the roulette wheel is chosen such that the sum of that value and the number value at the corresponding location at the first half 99*a* of the roulette wheel is a value of 61, which for the example wheel shown in FIG. 14, is the value 12 corresponding to a location in Group 1, Col. 2 of the corresponding game surface board of FIG. 13A; the next consecutive (second) value is chosen to correspond to a value that when added to a corresponding second value at the first half wheel 99*a* would equal 61 and this happens to correspond to a Group 2, col., 5 of the game board surface of FIG. 13A, and, is of the second color. It is readily seen that the consecutive $j^{th}$ pocket number values at each location starting from location 401 in FIG. 14, conform to a repeating pattern of Group and Columns of the corresponding game board as follows:

| GROUP | Col. |
|---|---|
| 1 | 2 |
| 2 | 5 |
| 3 | 1 |
| 1 | 4 |
| 2 | 3 |
| 3 | 2 |
| 1 | 5 |
| 2 | 1 |
| 3 | 4 |
| . | . |
| . | . |
| . | . |
| . | . |
| . | . |
| . | . |

As previously mentioned, in the embodiments of the roulette wheel 300 of FIG. 14, while four house numbers have been shown, it is understood that wheel may be provisioned with less than four (4) house numbers as depicted. For example, in the example embodiment depicted in FIG. 14, the house numbers indicated as 13 and 114 may be omitted, and correspondingly, the game board surface in FIG. 13A may reflect only two house number wager areas.

A further example roulette wheel arrangement 500 for use with the game surface 200 shown in FIG. 13A, is now depicted as shown in FIG. 15. In FIG. 15, there is depicted a roulette wheel 500 having three (3) house numbers first house number 413, second house number 414, and third house number 415. In the sequence shown in FIG. 15, the pockets may be arranged in the following counter-clockwise sequence with respect to a corresponding number: a first house number, 3, 32, 45, 6, 39, 48, 7, 40, 41, 4, 33, 42, 5, 36, 49, 13, 22, 55, 16 and 29, second house number, 58, 17, 30, 51, 14, 23, 52, 15, 26, 59, 18, 27, 60, 11, 24, 53, 12, 25, 56 and 19, third house number, 28, 57, 20, 21, 54, 8, 37, 50, 1, 34, 43, 2, 35, 46, 9, 38, 47, 10, 31 and 44.

In this example roulette wheel arrangement shown in FIG. 15, a first number value, e.g., 3, at a first pocket location at the periphery of the wheel corresponds to a location in Group 1, Col. 3 of the corresponding game surface board of FIG. 13A taken from left to right; the second value in a counter-clockwise direction is chosen to correspond to any different group and column number of the game board surface of FIG. 4, e.g., Group 2, Col., 2 and, is of the second color. The consecutive $j^{th}$ pocket number values at each consecutive location starting from location 501 in FIG. 15, and traversing counter-clockwise, conform to a repeating pattern of Group and Columns of the corresponding game board surface of FIG. 13A, from left to right as follows:

| GROUP | Col. |
|---|---|
| 1 | 3 |
| 2 | 2 |
| 3 | 5 |
| 1 | 1 |
| 2 | 4 |
| 3 | 3 |
| 1 | 2 |
| 2 | 5 |
| 3 | 1 |
| 1 | 4 |
| . | . |
| . | . |
| . | . |
| . | . |
| . | . |
| . | . |

It is also noted that if one traverses clockwise at number 58, (next to house number at 415) and traverses counter-clockwise the roulette wheel starting at number 3, and ignoring the house numbers, the sums of each pair of numbers equals 61 when one reaches 54 in the counter-clockwise direction. The numbers 54 to 12 in the counter-clockwise direction do not fit the pattern. Moreover, if one counts clockwise from number 3 and counter-clockwise from number 58, the sums of each pair of numbers equals 61, until one reaches number 7 in the counter-clockwise direction and 49 in the clockwise direction. However, if one starts from number 49 in the lower half and traverses in the clockwise direction, and one starts from 12 and traverses the roulette wheel in the counter-clockwise direction until the number 54 is reached, it is noted that the sum of each pair of numbers also equals 61. Nevertheless, these remaining numbers starting from 49 in the lower half until "7" in a clockwise direction and starting from 12 until 54 in the counterclockwise direction need not add up to 61, as long as the remaining criteria described herein are met.

Although not shown, it is understood that in the embodiment depicted in FIG. 14, the total number of arrangements of numbers (indicia) on the roulette wheel is 3!×5! or approximately 720 arrangements as there are six (6) Group permutations (1,2,3; 1,3,2; 2,1,3; 2,3,1; 3,1,2; and 3,2,1 and 120 column permutations (1,2,3,4,5; 1,2,3,5,4; 1,2, 4,3,5; 1,2,4, 5,3; etc.), with each arrangement possibly including the addition of two, three numbers (as shown in the embodiment of FIG. 15) or four house numbers (as shown in the embodiment of FIG. 14). However, it should be understood that generally, the game surface may be arranged in other forms, e.g., a different number of columns, groups and rows as long as the criteria is met that the pockets and corresponding numbers on the roulette wheel are arranged such that no two adjacent numbers on the roulette wheel are associated with a same color, are disposed in a same group on the associated game surface, are disposed in a same column on the associated game surface, are disposed in a same row on the associated game surface, or are disposed adjacent one another on the associated game surface.

A further advantage of a roulette game surface and wheel arrangement according to an embodiment of the invention is that the arrangement of numbers, colors and odd and even numbers is significantly more balanced.

That is, in the arrangements shown in FIGS. 13A, and 14 for example, the sum of the fifteen odd black numbers (1, 3, 5, 7, 9, 31, 33, 35, 37, 39, 41, 43, 45, 47 and 49,) equals 425, and the sum of the fifteen odd red numbers (11, 13, 15, 17, 19, 21, 23, 25, 27, 29, 51, 53, 55, 57 and 59) equals 475, giving a total of 900 as the sum of the odd numbers. The sum of the fifteen even black numbers in the arrangements shown in FIGS. 13A-14 (12, 14, 16, 18, 20, 22, 24, 26, 28, 30, 52, 54, 56, 58 and 60) equals 490 and the sum of the fifteen even red numbers (2, 4, 6, 8, 10, 32, 34, 36, 38, 40, 42, 44, 46, 48 and 50) equals 440, giving a total of 930 as the sum of the even numbers. However, the sum of the fifteen red even number values (440) and fifteen red odd number values (475) (which is equal to 915) is equal to the sum of the fifteen black even numbers (490) and fifteen black odd numbers (425). Additionally, from the perspective of the roulette wheel, looking at the top one quarter of the wheel labeled (quadrant) I of the wheel 100 depicted in FIG. 14, the number values are distributed such that the sum of the fifteen consecutive alternating red even and black odd numbers traversing clockwise (i.e., 49, 36, 5, 42, 33, 4, 41, 40, 7, 48, 39, 6, 45, 32 and 3) is 430 (208 black even and 222 black odd); and likewise, the sum of the fifteen consecutive alternating red even and black odd numbers in the other top half quadrant II of the wheel traversing clockwise from the second house number is 435 (232 red even numbers and 203 black odd numbers); and likewise, the sum of the fifteen consecutive alternating red odd and black even numbers in the bottom quadrant III of the wheel traversing counter-clockwise from the first house number is 485 (219 red odd numbers and 266 black even numbers) and the sum of the fifteen consecutive alternating red odd and black even numbers in the bottom quadrant IV of the wheel traversing counter-clockwise from the house number equals 480 (256 red odd and 224 black even). Thus, it readily follows that the sum of the fifteen consecutive number values in the quadrant I of the wheel added to the sum of the fifteen consecutive number values in the quadrant III of the wheel is 915, which is the same as the sum of the fifteen consecutive number values in the quadrant II of the wheel added to the sum of the fifteen consecutive number values in the quadrant IV of the wheel (915). Thus, the wheel is perfectly balanced.

Thus, as shown in FIG. 14, the sum of the numbers between the two house numbers 14, 113 on one side of wheel is exactly equal to the sum of the numbers between the two house numbers 14, 113 on the other side of the wheel, 915, evidencing the perfect balance of numbers on a wheel arrangement according to an embodiment of the invention.

Moreover, as shown in the embodiment of the roulette wheel depicted in FIG. 14, There is no place on the roulette wheel where two odd numbers or two even numbers are grouped together unlike the conventional arrangements where two odd numbers or two even numbers are grouped around the house number (0 or 00). For example, in the American roulette wheel shown in FIG. 2, the two even numbers 28 and 2 are separated by the house number 0 and the two odd numbers 27 and 1 are separated by the house number 00.

The side bet wagering area, in any roulette game board surface, may be placed anywhere on the game surface area. In the embodiments depicted herein, they are on the side on the top portion of the game board surface. The side bets in one embodiment consist of numbers 0 to 9 with the odds indicated for each digit on the game board surface. In another embodiment, the side bets consists of numbers 0 to 9; but in addition, those numbers comprised of the same digits, e.g. 11, 22, 33, 44, 55, etc. are placed in a another box. That is, the digits are represented by zz, wherein z is a number ranging from 1 to 9 and each z is the same number and zz is less than or equal to the total number of whole numbers on the roulette wheel. The odds in either case are calculated by determining the numbers of ways to lose the bet divided by the total number of possible digits matching the roulette wheel spin outcomes (total number of ways of winning the bet). From the calculation the odds may be rounded up or rounded down and these odds are depicted on the game board surface.

Thus, in accordance with the present invention, the present game is played as in regular roulette. Prior to the spinning of the wheel or during the spinning of the wheel but prior to the cessation of the revolution thereof, a player would place his bets on the outcome of the wheel in the wagering surfaces. In addition, in the present invention, the player has the option to make an additional side bet as to the digit of the outcome of the wheel and if present on the double-digit numbers. The player can bet on any one up to all of the boxes for the side bets. It is to be noted that if the double digit numbers are present as an option for a side bet, the double digit numbers are excluded from the scope of the boxes in the side bet wagering area having a single digit. If the outcome of the roulette wheel matches the digit or digits, if the latter is available, on which the player wagers, then the player wins at the odds indicated, regardless of any other bet that he has made on the side bet or on any other betting on the game board surface. If the outcome of the roulette wheel does not match any (the digit or double digit) box on which the player bets, then the player loses the side bet. However, the outcome of the side bet is independent of the wager conducted in other portions of the game board surface.

Figure 16:
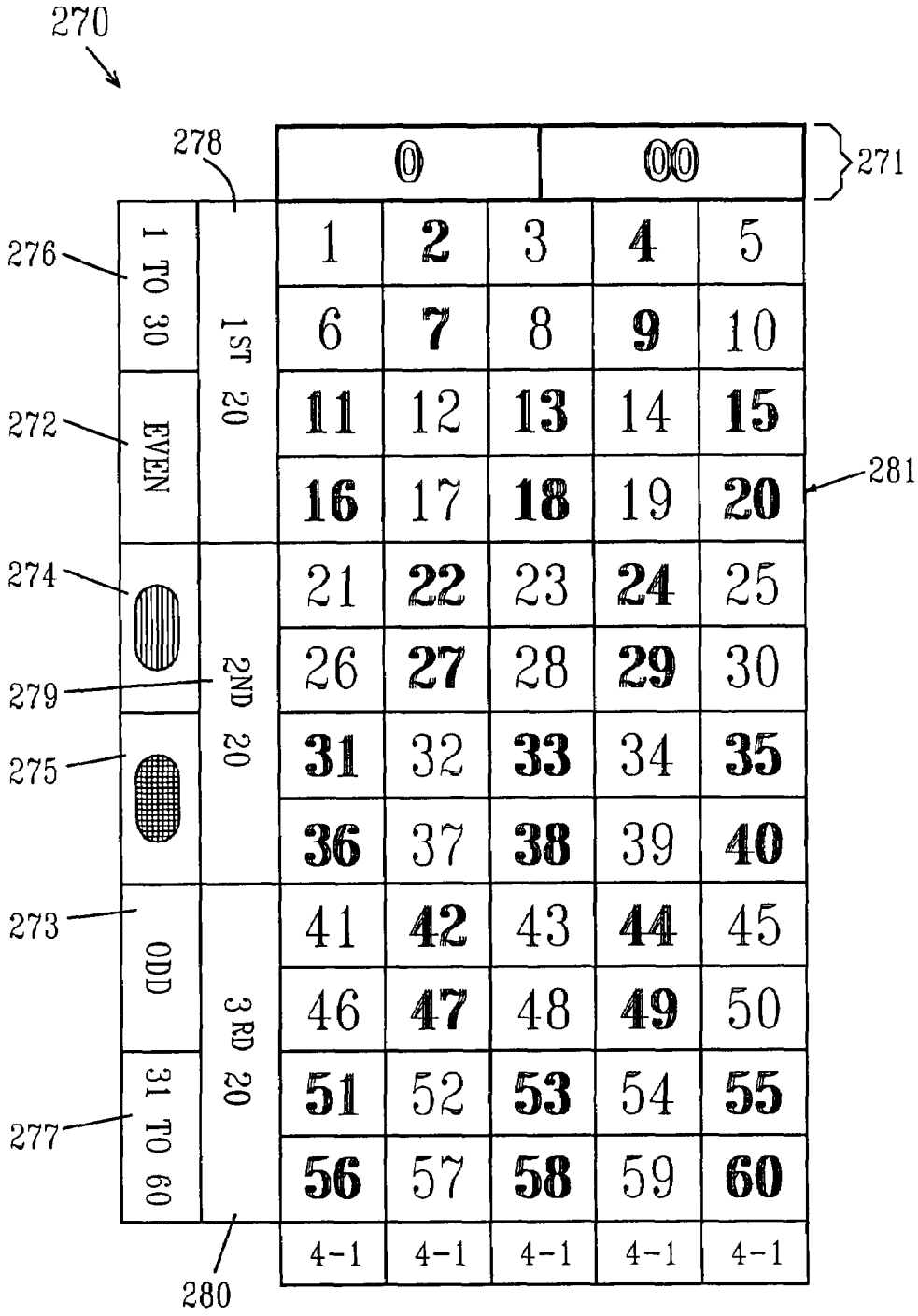
FIG. 16 depicts a game surface or board without the additional wagering area that can be used for a Super Roulette Wheel game, as described in co-pending and commonly owned U.S. patent application Ser. No. 11/725,073.

FIG. 16 depicts a game surface or board without the additional wagering area that can be used for a Super Roulette Wheel game, as described in co-pending U.S. patent application Ser. No. 11/725,073.

As illustrated in FIG. 16, an alternative roulette game surface 270 includes two (2) house number wagering areas 271 for placing a wager on a house number. The game surfaces also include an even number wagering area 272 for wagering on the even numbers (2, 4, 6, 8, 10, 12, 14, 16, 18, 20, 22, 24, 26, 28, 30, 32, 34, 36, 38, 40, 42, 44, 46, 48, 50, 52, 54, 56, 58 and 60) and an odd number wagering area 273 for wagering on the odd numbers (1, 3, 5, 7, 9, 11, 13, 15, 17, 19, 21, 23, 25, 27, 29, 31, 33, 35, 37, 39, 41, 43, 45, 47, 49, 51, 53, 55, 57, 59). The game surface further includes a first color wagering area 274 for wagering on numbers associated with a first color, for example red, and a second color wagering area 275 for wagering on numbers associated with a second color, for example black.

A game surface according to an embodiment of the invention further includes a low number wagering area 276 for wagering on the numbers from 1 to 30 and a high number wagering area 277 for wagering on the numbers from 31 to 60. A first other wagering area 278 for wagering on the numbers from 1 to 20, a second other wagering area 279 for wagering on the numbers from 21 to 40, and a third other wagering area 280 for wagering on the numbers from 41 to 60 are also disposed on the game surface.

Sixty individual number wagering areas 281, each corresponding to a whole number from 1 to 60 are arranged on the game surface. As shown, the sixty individual number wagering areas are arranged in ascending order from left to right in a matrix of five columns and twelve rows.

As shown in FIG. 16, in a game surface according to an embodiment of the invention, the sixty individual whole numbers are evenly distributed in a perfectly balanced manner wherein fifteen odd numbers are associated with a first color (for example red), fifteen odd numbers are associated with a second color (for example black), fifteen even numbers are associated with a first color (for example red) and fifteen even numbers are associated with a second color (for example black).

Moreover, each of the five columns in the game surface 270 comprises six numbers associated with the first color and six numbers associated with the second color. Each of the columns in a game surface according to an embodiment of the invention comprises six odd numbers and six even numbers. Each of the columns in a game surface according to an embodiment of the invention comprises three even numbers associated with the first color, three even numbers associated with the second color, three odd numbers associated with the first color and three odd numbers associated with the second color.

Additionally, each of the three groups of twenty numbers corresponding to the first, second and third other wagering areas in the game surface 270 as shown in FIG. 16 comprises five even numbers associated with the first color, five even numbers associated with the second color, five odd numbers associated with the first color and five odd numbers associated with the second color.

In a further demonstration of balancing in the game surface embodiment of FIG. 16, one half of the sixty individual number wagering areas 281, e.g., wagering areas numbered 1-30, include seven black odd numbers (7, 9, 11, 13, 15, 27 and 29) and include seven black even numbers (2, 4, 16, 18, 20, 22 and 24). Similarly, the same half including wagering areas numbered 1-30 include eight red odd numbers (1, 3, 5, 17, 19, 21, 23, and 25) and include eight red even numbers (6, 8, 10, 12, 14, 26, 28 and 30). Similarly, the other half of the sixty individual number wagering areas 281, e.g., wagering areas numbered 31-60, include eight black odd numbers (31, 33, 35, 47, 49, 51, 53 and 55) and include eight black even numbers (36, 38, 40, 42, 44, 56, 58 and 60). Similarly, the same half including wagering areas numbered 31-60 include seven red odd numbers (37, 39, 41, 43, 45, 57, and 59) and include seven red even numbers (32, 34, 46, 48, 50, 52 and 54).

For example, as shown in the game surface 270 illustrated in FIG. 16, individual number wagering areas corresponding to numbers 1, 3, 5, 6, 8, 10, 12, 14, 17, 19, 21, 23, 25, 26, 28, 30, 32, 34, 37, 39, 41, 43, 45, 46, 48, 50, 52, 54, 57 and 59 are associated with a first color (e.g., red), and individual number wagering areas corresponding to numbers 2, 4, 7, 9, 11, 13, 15, 16, 18, 20, 22, 24, 27, 29, 31, 33, 35, 36, 38, 40, 42, 44, 47, 49, 51, 53, 56, 58 and 60 are associated with a second color (e.g., black). It is understood that the color scheme for the numbers may be reversed, i.e., individual number wagering areas corresponding to numbers 1, 3, 5, 6, 8, 10, 12, 14, 17, 19, 21, 23, 25, 26, 28, 30, 32, 34, 37, 39, 41, 43, 45, 46, 48, 50, 52, 54, 57 and 59 may be associated with a first color (e.g., black), and individual number wagering areas corresponding to numbers 2, 4, 7, 9, 11, 13, 15, 16, 18, 20, 22, 24, 27, 29, 31, 33, 35, 36, 38, 40, 42, 44, 47, 49, 51, 53, 56, 58 and 60 may be associated with a second color (e.g., red).

Figure 17:
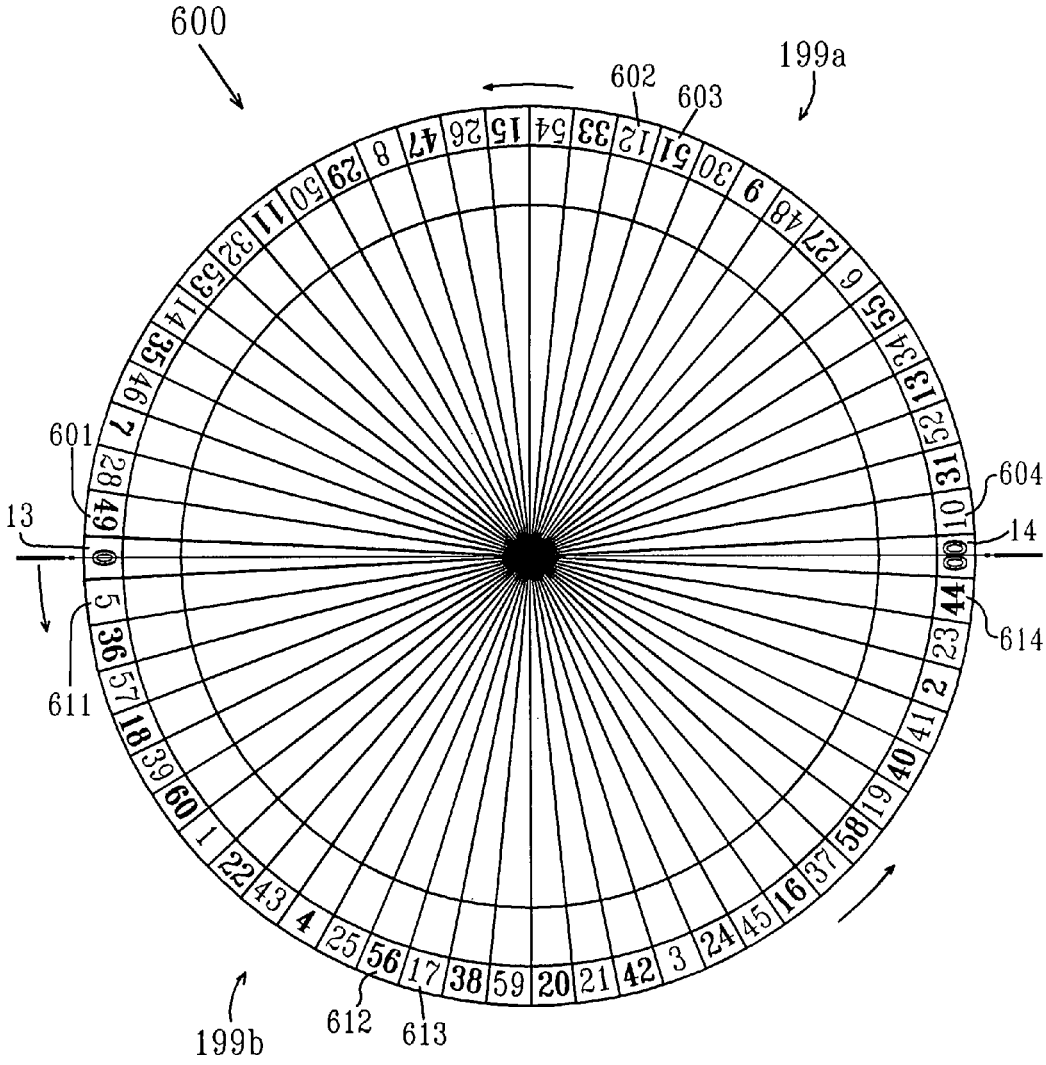
FIG. 17 depicts a roulette wheel arrangement corresponding to a game surface of a super wheel game, as described in co-pending and commonly owned U.S. patent application Ser. No. 11/725,073

FIG. 17 depicts an exemplary roulette wheel arrangement 600 corresponding to the game board surface 270 of FIG. 16. As shown, the roulette wheel 600 includes a plurality of pockets 12 disposed in a circumferential manner, for example the wheel shown in FIG. 17 may have sixty-two pockets.

As shown in FIG. 17, each of the pockets 12 correspond to either a house number 13, 14, or, to one of the whole numbers from 1 to 60. Each of the whole numbers on the wheel is associated with a first color or a second color conforming to the association of numbers and colors on the game surface of FIG. 16 to be used with the particular wheel. It should be understood that while two house numbers (13, 14) are shown in the embodiments depicted in FIG. 17 in diametrically opposite positions on the wheel, it is understood that two additional diametrically opposed house numbers may be included, thus, making a total of four house numbers for these embodiments.

That is, it is understood that, for the roulette wheel arrangement shown in FIG. 17, the wheel may have four house numbers, e.g., two 0s and two 00s or, 4 0s or, 4 00s or combination thereof disposed diametrically opposite one another. In other embodiments, there may be three or less house numbers.

According to a further embodiment of the invention, the pockets and corresponding numbers on the roulette wheel 600 as shown in FIG. 17, are arranged such that when traversing the roulette wheel clockwise beginning at a first location as shown in FIG. 17, the successive pockets and corresponding indicia may be arranged in the following clockwise sequence with respect to a corresponding number: a first house number, 49, 28, 7, 46, 35, 14, 53, 32, 11, 50, 29, 8, 47, 26, 15, 54, 33, 12, 51, 30, 9, 48, 27, 6, 55, 34, 13, 52, 31 and 10, a second house number, 44, 23, 2, 41, 40, 19, 58, 37, 16, 45, 24, 3, 42, 21, 20, 59, 38, 17, 56, 25, 4, 43, 22, 1, 60, 39, 18, 57, 36 and 5.

In an embodiment of the present invention, e.g., the roulette wheel arrangement shown in FIG. 17, the first number value, e.g., 49, placed in the one half 199*a* of the roulette wheel beginning at a first pocket location 601 and a corresponding value seventeen pocket positions later in a clockwise direction, at a second pocket location 602, e.g., a value of 12, add up to 61. Successive pocket indicia values in adjacent pockets from position 601 in a clockwise direction and a corresponding successive indicia values in adjacent pockets from position 602 in a counter-clockwise direction, add to 61 as follows: 49 and 12, 28 and 33, 7 and 54, . . . , 11 and 50. Similarly, in this example roulette wheel arrangement shown in FIG. 17, the next successive number value 603, i.e., a number value 51, placed at a pocket position nineteen in the one half 199*a* of the roulette wheel and a corresponding value eleven pocket positions later at a second pocket location 604 in a clockwise direction, e.g., a value of 10, add up to 61. Successive indicia values in adjacent pockets from position 603 in a clockwise direction and a corresponding successive indicia values in adjacent pockets from position 604 in a counter-clockwise direction, add to 61 as follows: 51 and 10, 30 and 31, 9 and 52, . . . , 6 and 55.

Likewise, in this embodiment, as depicted in roulette wheel arrangement shown in FIG. 17, the first number value, e.g., 5, placed in the other half 199*b* of the roulette wheel 600 beginning at a first pocket location 611 and a corresponding value eleven pocket positions later in a counter-clockwise direction at a second pocket location 612, e.g., a value of 56, add up to 61. Successive pocket indicia values in adjacent pockets from position 611 in a counter-clockwise direction and a corresponding successive indicia values in adjacent pockets from position 612 in a clockwise direction, add to 61 as follows: 5 and 56, 36 and 25, 57 and 4, . . . , 60 and 1. Similarly, in this example roulette wheel arrangement shown in FIG. 17, the next successive number value 613, i.e., a number value 17, placed at a pocket position thirteen in the other half 199*b* of the roulette wheel 600 and a corresponding value seventeen pocket positions later at a second pocket location 614 in a counter-clockwise direction, e.g., a value of 44, add up to 61. Successive indicia values in adjacent pockets from position 613 in a counter-clockwise direction and corresponding successive indicia values in adjacent pockets from position 614 in a clockwise direction, add to 61 as follows: 17 and 44, 38 and 23, 59 and 2, . . . , 45 and 16.

As previously mentioned, in the embodiments of the roulette wheel 600 of FIG. 17, while two house numbers have been shown, it is understood that wheel may be provisioned with up to four (4) house numbers. For example, in the example embodiment depicted in FIG. 17, additional house numbers may be provided at diametrically opposite locations on the wheel.

It should be understood that generally, in the game wheel 600 of FIG. 17, the pockets and corresponding numbers on the roulette wheel are arranged such that no two adjacent numbers on the roulette wheel are associated with a same color, are disposed in a same group on the associated game surface of FIG. 16, are disposed in a same column on the associated game surface of FIG. 16, are disposed in a same row on the associated game surface of FIG. 16, or are disposed adjacent one another on the associated game surface of FIG. 16.

A further advantage of a roulette game surface and wheel arrangement according to an embodiment of the invention is that the arrangement of numbers, colors and odd and even numbers is significantly more balanced.

In one example, for instance, as depicted in FIG. 17, it is seen how in the one half 199*a* of the wheel 600 between pocket locations 601 and 604, all black numbers are odd and all red numbers are even. Similarly, it is seen how in the other half 199*b* of the wheel 600 between pocket locations 611 and 614, all black numbers are even and all red numbers are odd.

In a further embodiment, and a demonstration of the balanced arrangement of the wheel 600 of FIG. 17, for example, the sum of the fifteen odd black numbers (49, 7, 35, 53, 11 29, 47, 15, 33, 51, 9, 27, 55, 13 and 31) and the sum of the fifteen even red numbers (28, 46, 14, 32, 50, 8, 26, 54, 12, 30, 48, 6, 34, 52 and 10) in one half 199*a* of the wheel equals a total of 915 as the sum. Likewise, the sum of the fifteen red odd numbers (5, 57, 39, 1, 43, 25, 17, 59, 21, 3, 45, 37, 19, 41 and 23) and fifteen black even number values (36, 18, 60, 22, 4, 56, 38, 20, 42, 24, 16, 58, 40 and 2) is equal to the sum of the 915. Thus, the wheel is balanced.

That is, in an embodiment, as shown in FIG. 17, the sum of the numbers between the two house numbers 13, 14 on one side of wheel is exactly equal to the sum of the numbers between the two house numbers on the other side of the wheel, 915, evidencing the perfect balance of numbers on a wheel arrangement according to an embodiment of the invention.

Moreover, as shown in an embodiment of the roulette wheel 600 depicted in FIG. 17, there is a place on the roulette wheel where two odd numbers or two even numbers are grouped together around the house number (0 or 00). For example, in FIG. 17, the two odd numbers 49 and 5 are separated by the house number 0, however, in this aspect of the invention, these indicia are opposite colors. Similarly, for example, in FIG. 17, the two even numbers 10 and 44 are separated by the house number 00, however, in this aspect of the invention, these indicia are opposite colors.

As referred to herein, the terms "additional wager area" and "side bet waging area" are used interchangeably and are synonymous.

Accordingly, while several embodiments of the present invention have been shown and described, it is obvious that many changes and modifications may be made thereunto without departing from the spirit and scope of the invention. For example, the roulette wheel and game surface embodiments including the additional wagering area of the invention may be adapted for use in other like gaming devices, e.g., a pin-wheel game.

What is claimed is:

1. In a roulette game apparatus having a roulette wheel comprising a plurality of indicia arranged in a circumferential manner about said roulette wheel, each of said indicia associated with a unique whole number and a color, and further comprising means for operating said wheel for generating an outcome or result comprising a one digit or two digit number and associated color, and house numbers, and, a roulette game surface having one or more wagering areas for placing wagers on an outcome or result of a roulette wheel operation, wherein said wagering areas for placing wagers includes one or more house number wagering areas, wagering areas for each individual single digit or two-digit whole number outcomes, wagering areas for placing wagers on a group of numbers, wagering areas for wagering on odd number or even number outcomes, and, wagering areas for wagering on a color outcome, an improvement comprising: an additional wagering area for said game surface comprising ten individual wagering areas corresponding to a digit value 0, . . . , 9, wherein a bettor conducts a wager by placing a marker means on a particular digit value 0, . . . , 9 of said side wagering area for indicating a wager that a resulting digit of said one digit or either one of the two digits of the two digit whole number outcomes will match that digit value being wagered.

2. The improved roulette game apparatus according to claim 1, wherein a winning wager payout ratio is associated with each of said one or more wagering areas of said game surface, and, a wager payout ratio is associated with each of said ten individual wagering areas of said side additional wagering area.

3. The improved roulette game apparatus according to claim 2, wherein said plurality of indicia comprises whole numbers ranging between from between 1 to 36 inclusive.

4. The improved roulette game apparatus according to claim 3, wherein said side wagering area of said game surface further comprises:

a further individual side wagering area associated with one or more two digit numbers zz where z =1, 2 or 3, a wager payout ratio being associated with said further individual side wagering area, wherein a user is enabled to conduct a wager by placing a marker means on said further individual side wagering area for indicating a wager that a resulting two digit number outcome will match the number zz, wherein the double digit zz whole number outcome is excluded from the scope of a single individual wagering area associated with whole number z of said additional wagering area.

5. The improved roulette game apparatus according to claim 4, having only one or two house numbers and an equal number of house number wagering area.

6. The improved roulette game apparatus according to claim 3, wherein said roulette game surface comprises:

(i) one or more house number wagering areas;
(ii) an even number wagering area;
(iii) an odd number wagering area;
(iv) a first color wagering area;
(v) a second color wagering area;
(vi) a low number wagering area corresponding to a whole number from 1 to 18;
(vii) a high number wagering area corresponding to a whole number from 19 to 36;
(viii) a first dozen wagering area corresponding to a whole number from 1 to 12;
(ix) a second dozen wagering area corresponding to a whole number from 13 to 24;
(x) a third dozen wagering area corresponding to a whole number from 25 to 36; and
(xi) thirty six individual number wagering areas, each corresponding to a whole number from 1 to 36, said thirty six individual number wagering areas arranged in ascending order from left to right in a matrix of three columns and twelve rows and in three groups of twelve numbers each, a first group comprising the numbers 1 through 12, a second group comprising the numbers 13 through 24 and a third group comprising the numbers 25 through 36.

7. The improved roulette game apparatus according to claim 6, wherein said plurality of indicia arranged in a circumferential manner about said wheel are arranged such that no two adjacent numbers on the roulette wheel are associated with a same color, are disposed in a same group on the game surface, are disposed in a same column on the game surface, are disposed in a same row on the game surface, or are disposed adjacent one another on the game surface.

8. The improved roulette game apparatus according to claim 7, wherein said individual number wagering areas of said game board surface corresponding to numbers 1, 3, 4, 6, 8, 11, 13, 15, 16, 18, 20, 23, 25, 27, 28, 30, 32 and 35 are associated with said first color, and individual number wagering areas corresponding to numbers 2, 5, 7, 9, 10, 12, 14, 17, 19, 21, 22, 24, 26, 29, 31, 33, 34 and 36 are associated with said second color.

9. The improved roulette game apparatus according to claim 8, wherein said indicia are arranged in the following clockwise sequence with respect to a corresponding number: a first house number, 22, 11, 36, 13, 2, 28, 21, 8, 33, 20, 31, 18, 7, 32, 12, 23, 34, 3, a second house number, 15, 26, 1, 24, 35, 9, 16, 29, 4, 17, 6, 19, 30, 5, 25, 14, 27 and 10.

10. The improved roulette game apparatus according to claim 8, wherein said indicia are arranged in the following clockwise sequence with respect to a corresponding number: a house number, 15, 26, 1, 24, 35, 9, 16, 29, 4, 17, 6, 19, 30, 5, 25, 14, 27, 10, 3, 22, 11, 36, 13, 2, 28, 21, 8, 33, 20, 31, 18, 7, 32, 12, 23 and 34.

11. The improved roulette game apparatus according to claim 8, wherein said indicia are arranged in the following clockwise sequence with respect to a corresponding number: a first house number, 33, 20, 7, 30, 17, 6, 31, 18, 5, 27, 22, 11, 36, 13, 2, 25, 14, 3 a second house number, 10, 15, 26, 1, 24, 35, 12, 23, 34, 8, 19, 32, 9, 16, 29, 4, 21 and 28.

12. The improved roulette game apparatus according to claim 8, wherein said indicia are arranged in the following clockwise sequence with respect to a corresponding number: a house number, 10, 35, 24, 11, 34, 15, 2, 13, 26, 6, 19, 30, 5, 18, 29, 4, 17, 28, 21, 8, 31, 20, 7, 32, 9, 16, 33, 1, 36, 23, 12, 25, 14, 3, 22, and 27.

13. The improved roulette game apparatus according to claim 6, wherein said indicia are arranged on said roulette wheel such that each pair of numbers disposed substantially diametrically across from one another on the roulette wheel is disposed in the same group on the game surface and in the same column on the game surface.

14. The improved roulette game apparatus according to claim 13, wherein individual number wagering areas of said game board surface corresponding to numbers 1, 3, 4, 8, 11, 12, 13, 16, 18, 20, 21, 23, 25, 27, 28, 32, 35 and 36 are associated with said first color, and individual number wagering areas corresponding to numbers 2, 5, 6, 7, 9, 10, 14, 15, 17, 19, 22, 24, 26, 29, 30, 31, 33 and 34 are associated with said second color.

15. The improved roulette game apparatus according to claim 14, wherein said indicia are arranged in the following clockwise sequence with respect to a corresponding number: a first house number, 8, 15, 28, 9, 16, 29, 4, 17, 27, 2, 21, 34, 3, 22, 35, 10, 23, 30, a second house number, 11, 24, 25, 6, 13, 26, 1, 14, 36, 5, 18, 31, 12, 19, 32, 7, 20 and 33.

16. The improved roulette game apparatus according to claim 14, wherein said indicia are arranged in the following clockwise sequence with respect to a corresponding number: a house number, 8, 15, 28, 9, 16, 29, 4, 17, 27, 2, 21, 34, 3, 22, 35, 10, 23, 30, 11, 24, 25, 6, 13, 26, 1, 14, 36, 5, 18, 31, 12, 19, 32, 7, 20 and 33.

17. The improved roulette game apparatus according to claim 2, wherein said plurality of indicia comprises whole numbers ranging between from between 1 to 60 inclusive.

18. The improved roulette game apparatus according to claim 17, wherein said roulette game surface comprises:

(i) one or more house number wagering areas;
(ii) an even number wagering area;
(iii) an odd number wagering area;
(iv) a first color wagering area;
(v) a second color wagering area;
(vi) a low number wagering area corresponding to a whole number from 1 to 30;
(vii) a high number wagering area corresponding to a whole number from 31 to 60;
(viii) a first other wagering area corresponding to a whole number from 1 to 20;
(ix) a second other wagering area corresponding to a whole number from 21 to 40;
(x) a third other wagering area corresponding to a whole number from 41 to 60; and
(xi) sixty individual number wagering areas, each corresponding to a whole number from 1 to 60, said sixty individual number wagering areas arranged in ascending order from left to right in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 are associated with said first color, and individual number wagering areas corresponding to numbers 2, 4, 6, 8, 10, 11, 13, 15, 17, 19, 21, 23, 25, 27, 29, 32, 34, 36, 38, 40, 42, 44, 46, 48, 50, 51, 53, 55, 57 and 59 are associated with said second color.

19. The improved roulette game apparatus according to claim 18, wherein said indicia are arranged in the following clockwise sequence with respect to a corresponding number: a first house number, 49, 36, 5, 42, 33, 4, 41, 40, 7, 48, 39, 6, 45, 32 and 3, an optional second house number, 44, 31, 10, 47, 38, 9, 46, 35, 2, 43, 34, 1, 50, 37 and 8, an optional third house number, 53, 24, 11, 60, 27, 18, 59, 26, 15, 52, 23, 14, 51, 30, 17, an optional fourth house number, 58, 29, 16, 55, 22, 13, 54, 21, 20, 57, 28, 19, 56, 25 and 12.

20. The improved roulette game apparatus according to claim 19, wherein said second optional and fourth optional house numbers are omitted.

21. The improved roulette game apparatus according to claim 18, wherein said indicia are arranged in the following counter clockwise sequence with respect to a corresponding number: a first house number, 3, 32, 45, 6, 39, 48, 7, 40, 41, 4, 33, 42, 5, 36, 49, 13, 22, 55, 16 and 29, second house number, 58, 17, 30, 51, 14, 23, 52, 15, 26, 59, 18, 27, 60, 11, 24, 53, 12, 25, 56 and 19, third house number, 28, 57, 20, 21, 54, 8, 37, 50, 1, 34, 43, 2, 35, 46, 9, 38, 47, 10, 31 and 44.

22. A roulette game apparatus comprising:

(a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 18;

(vii) a high number wagering area corresponding to a whole number from 19 to 36;

(viii) a first dozen wagering area corresponding to a whole number from 1 to 12;

(ix) a second dozen wagering area corresponding to a whole number from 13 to 24;

(x) a third dozen wagering area corresponding to a whole number from 25 to 36; and (xi) thirty six individual number wagering areas, each corresponding to a whole number from 1 to 36, said thirty six individual number wagering areas arranged in ascending order from left to right in a matrix of three columns and twelve rows and in three groups of twelve numbers each, a first group comprising the numbers 1 through 12, a second group comprising the numbers 13 through 24 and a third group comprising the numbers 25 through 36; wherein individual number wagering areas corresponding to numbers 1, 3, 4, 6, 8, 11, 13, 15, 16, 18, 20, 23, 25, 27, 28, 30, 32 and 35 are associated with said first color, and individual number wagering areas corresponding to numbers 2, 5, 7, 9, 10, 12, 14, 17, 19, 21, 22, 24, 26, 29, 31, 33, 34 and 36 are associated with said second color; and, (xii) an additional wagering area comprising ten individual wagering areas corresponding to a digit value 0, . . . , 9, wherein a bettor may conduct a wager by placing a marker means on a particular digit value 0, . . . , 9 of said additional wagering area for indicating a wager that a resulting digit of a one digit or either one of the two digits of the two digit whole number roulette spin outcome will match that digit value being wagered; and, (b) a roulette wheel comprising a plurality of pockets disposed in a circumferential manner, each of said pockets corresponding to a house number or to a whole number from 1 to 36, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface.

23. The roulette game apparatus as claimed in claim 22, wherein said additional wagering area of said game surface further comprises:

a further individual side wagering area associated with one or more two digit numbers zz where z =1, 2 or 3, a wager payout ratio being associated with said further individual side wagering area, wherein a user is enabled to conduct a wager by placing a marker means on said further individual side wagering area for indicating a wager that a resulting two digit number outcome will match the number zz.

24. A roulette game apparatus comprising:

(a) a game surface comprising:

(i) one or more house number wagering areas;

(ii) an even number wagering area;

(iii) an odd number wagering area;

(iv) a first color wagering area;

(v) a second color wagering area;

(vi) a low number wagering area corresponding to a whole number from 1 to 18;

(vii) a high number wagering area corresponding to a whole number from 19 to 36;

(viii) a first dozen wagering area corresponding to a whole number from 1 to 12;

(ix) a second dozen wagering area corresponding to a whole number from 13 to 24;

(x) a third dozen wagering area corresponding to a whole number from 25 to 36; and (xi) thirty six individual number wagering areas, each corresponding to a whole number from 1 to 36, said thirty six individual number wagering areas arranged in ascending order from left to right in a matrix of three columns and twelve rows and in three groups of twelve numbers each, a first group comprising the numbers 1 through 12, a second group comprising the numbers 13 through 24 and a third group comprising the numbers 25 through 36; wherein individual number wagering areas corresponding to numbers 1, 3, 4, 8, 11, 12, 13, 16, 18, 20, 21, 23, 25, 27, 28, 32, 35 and 36 are associated with said first color, and individual number wagering areas corresponding to numbers 2, 5, 6, 7, 9, 10, 14, 15, 17, 19, 22, 24, 26, 29, 30, 31, 33 and 34 are associated with said second color; and, (xii) an additional wagering area comprising ten individual wagering areas corresponding to a digit value 0, . . . , 9, wherein a bettor may conduct a wager by placing a marker means on a particular digit value 0, . . . , 9 of said side wagering area for indicating a wager that a resulting digit of one digit or either one of the two digits of the two digit whole number roulette spin outcome will match that digit value being wagered; and, (b) a roulette wheel comprising a plurality of pockets disposed in a circumferential manner, each of said pockets corresponding to a house number or to a whole number from 1 to 36, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface and such that each pair of numbers disposed substantially diametrically across from one another on the roulette wheel is disposed in the same group on the game surface and in the same column on the game surface.

25. The roulette game apparatus as claimed in claim 24, wherein said additional wagering area of said game surface further comprises:

a further individual side wagering area associated with one or more two digit numbers zz where z = 1, 2 or 3, a wager payout ratio being associated with said further individual side wagering area, wherein a user is enabled to conduct a wager by placing a marker means on said further individual side wagering area for indicating a wager that a resulting two digit number outcome will match the number zz, wherein a double digit number zz whole number outcome is excluded from the scope of a single individual wagering area associated with whole number z of said additional wagering area.

26. A roulette game apparatus comprising:

(a) a game surface comprising:

(i) one or more house number wagering areas;

(ii) an even number wagering area (iii) an odd number wagering area (iv) a first color wagering area;

(v) a second color wagering area;

(vi) a low number wagering area corresponding to a whole number from 1 to 30;

(vii) a high number wagering area corresponding to a whole number from 31 to 60;

(viii) a first other wagering area corresponding to a whole number from 1 to 20;

(ix) a second other wagering area corresponding to a whole number from 21 to 40;

(x) a third other wagering area corresponding to whole number from 41 to 60; and (xi) sixty individual number wagering areas, each corresponding to a whole number from 1 to 60, said sixty individual number wagering areas arranged in ascending order from left to right in a matrix of five columns and twelve rows and in three groups of twenty numbers each, a first group comprising the numbers 1 through 20, a second group comprising the numbers 21 through 40 and a third group comprising the numbers 41 through 60; wherein individual number wagering areas corresponding to numbers 1, 3, 5, 7, 9, 12, 14, 16, 18, 20, 22, 24, 26, 28, 30, 31, 33, 35, 37, 39, 41, 43, 45, 47, 49, 52, 54, 56, 58 and 60 are associated with said first color, and individual number wagering areas corresponding to numbers 2, 5, 6, 8, 10, 11, 13, 15, 17, 19, 21, 23, 25, 27, 29, 32, 34, 36, 38, 40, 42, 44, 46, 48, 50, 51, 53, 55, 57 and 59 are associated with said second color; and (xii) an additional wagering area comprising ten individual wagering areas corresponding to a digit value 0, . . . , 9, wherein a bettor may conduct a wager by placing a marker means on a particular digit value 0, . . . , 9 of said side wagering area for indicating a wager that a resulting digit of a one digit or either one of the two digits of the two digit whole number roulette spin outcome will match that digit value being wagered; and (b) a roulette wheel comprising a plurality of pockets disposed in a circumferential manner, each of said pockets corresponding to a house number or to a whole number from 1 to 60, wherein each of the whole numbers is associated with said first color or said second color as on said game surface, and wherein said pockets are arranged on said roulette wheel such that no two adjacent numbers on the roulette wheel are associated with a same color, are disposed in a same group on the game surface, are disposed in a same column on the game surface, are disposed in a same row on the game surface, or are disposed adjacent one another on the game surface and, such that there are three pockets having house numbers distributed evenly about said circumference.

27. A method of playing a roulette game comprising:

providing a roulette wheel assembly comprising a plurality of indicia arranged in a circumferential manner about said roulette wheel, each of said indicia associated with a unique whole number and a color, and further comprising means for operating said wheel for generating an outcome or result comprising a one digit or two digit number and associated color, and, a roulette game surface having one or more wagering areas for placing wagers on an outcome or result of a roulette wheel operation, wherein said wagering areas for placing wagers includes one or more house number wagering areas, wagering areas for each individual single digit or two-digit whole number outcomes, wagering areas for placing wagers on a group of numbers, wagering areas for wagering on odd number or even number outcomes, and, wagering areas for wagering on a color outcome; and, providing a roulette game surface having one or more wagering areas for placing wagers on an outcome or result of a roulette wheel operation, wherein said wagering areas for placing wagers includes one or more house number wagering areas, wagering areas for each individual single digit or two-digit whole number outcomes, wagering areas for placing wagers on a group of numbers, wagering areas for wagering on odd number or even number outcomes, and, wagering areas for wagering on a color outcome;

providing an additional wagering area for said game surface comprising ten individual wagering areas corresponding to a digit value 0, . . . , 9;

accepting a bet placed by a player in one or more of said one or more wagering areas for placing wagers or, in one or more of said ten individual wagering areas of said additional wagering area corresponding to a digit value of 0, . . . , 9;

operating said roulette wheel to determine a roulette wheel outcome;

declaring each whole number digit of said roulette wheel outcome as a winning number; and, paying off bets placed in said additional wagering area when a resulting digit of said one digit or either one of the two digits of the two digit whole number outcome match that digit value being wagered in said additional wagering area.

28. The method as claimed in claim 27, further comprising:

providing a further individual side wagering area associated with one or more two digit numbers zz where z is a number ranging from 1 to 9, and zz is a number less than or equal to the largest number of whole numbers on the roulette wheel game surface or roulette wheel, a wager payout ratio being associated with said further individual side wagering area, wherein a user is enabled to conduct a wager by placing a marker means on said further individual side wagering area for indicating a wager that a resulting two digit number outcome will match the number zz, wherein a bet placed in said further individual side wagering area is paid off when a resulting two digit whole number outcome matches zz, wherein a double digit number zz whole number outcome is excluded from the scope of a single individual wagering area associated with whole number z of said additional wagering area.

* * * * *